US006935096B2

(12) United States Patent
Haiun

(10) Patent No.: US 6,935,096 B2
(45) Date of Patent: Aug. 30, 2005

(54) THERMO-KINETIC COMPRESSOR

(76) Inventor: Joseph Haiun, 79/81, Route de la Reine, Boulogne Billancourt (FR), F-92100

( * ) Notice: Subject to any disclaimer, the term of this patent is extended or adjusted under 35 U.S.C. 154(b) by 130 days.

(21) Appl. No.: 10/203,961

(22) PCT Filed: Jan. 25, 2001

(86) PCT No.: PCT/FR01/00230

§ 371 (c)(1),
(2), (4) Date: Aug. 15, 2002

(87) PCT Pub. No.: WO01/61196

PCT Pub. Date: Aug. 23, 2001

(65) Prior Publication Data

US 2003/0012658 A1 Jan. 16, 2003

(30) Foreign Application Priority Data

Feb. 16, 2000 (FR) ..... 00 01881

(51) Int. Cl.[7] ..... F02C 7/10; B01F 3/04
(52) U.S. Cl. ..... 60/39.5; 261/115; 261/DIG. 78
(58) Field of Search ..... 60/39.41, 39.5, 60/39.53, 39.54; 261/115, DIG. 78

(56) References Cited

U.S. PATENT DOCUMENTS 891,901 A * 6/1908 Blieden et al. ..... 60/39.5
1,134,365 A * 4/1915 Barnes ..... 261/133
2,926,493 A * 3/1960 Poole et al. ..... 60/39.5
3,369,361 A * 2/1968 Craig ..... 60/39.5
3,782,116 A * 1/1974 Burge et al. ..... 60/39.5
3,915,222 A 10/1975 Hull
4,260,563 A * 4/1981 Brulhet ..... 261/115
4,267,131 A * 5/1981 Prudhon et al. ..... 261/115
4,272,499 A * 6/1981 Cason et al. ..... 261/DIG. 78
4,867,918 A * 9/1989 Kiyonaga et al. .... 261/DIG. 78
5,262,091 A * 11/1993 Narabayashi et al. ..... 417/176

FOREIGN PATENT DOCUMENTS

| | | |
|---|---|---|
| BE | 537 693 | 5/1959 |
| EP | 0 514 914 | 11/1992 |
| GB | 928661 | 6/1963 |

* cited by examiner

*Primary Examiner*—Michael Koczo
(74) *Attorney, Agent, or Firm*—Young & Thompson

(57) ABSTRACT

A device for compressing gas using thermal energy. In a subsonic embodiment the heat gas passes through a convergent pipe C1 where it is provided with operating velocity, a convergent pipe C2 where it is simultaneously maintained at high speed and cooled by evaporation of liquid sprayed by nozzles R with adjustable position distributed in C2. In a supersonic embodiment, the gas reaches sonic velocity at the throat of C2 and supersonic velocity in a divergent DG, then compressed in a convergent CG1 and simultaneously cooled by evaporation of sprayed liquid. In both embodiments, the gas is finally compressed in a subsonic divergent DG1. Pipes with variable geometry enable to modify the cross-sections of the throats of the device. The device is essentially designed for thermoelectric power stations.

13 Claims, 11 Drawing Sheets

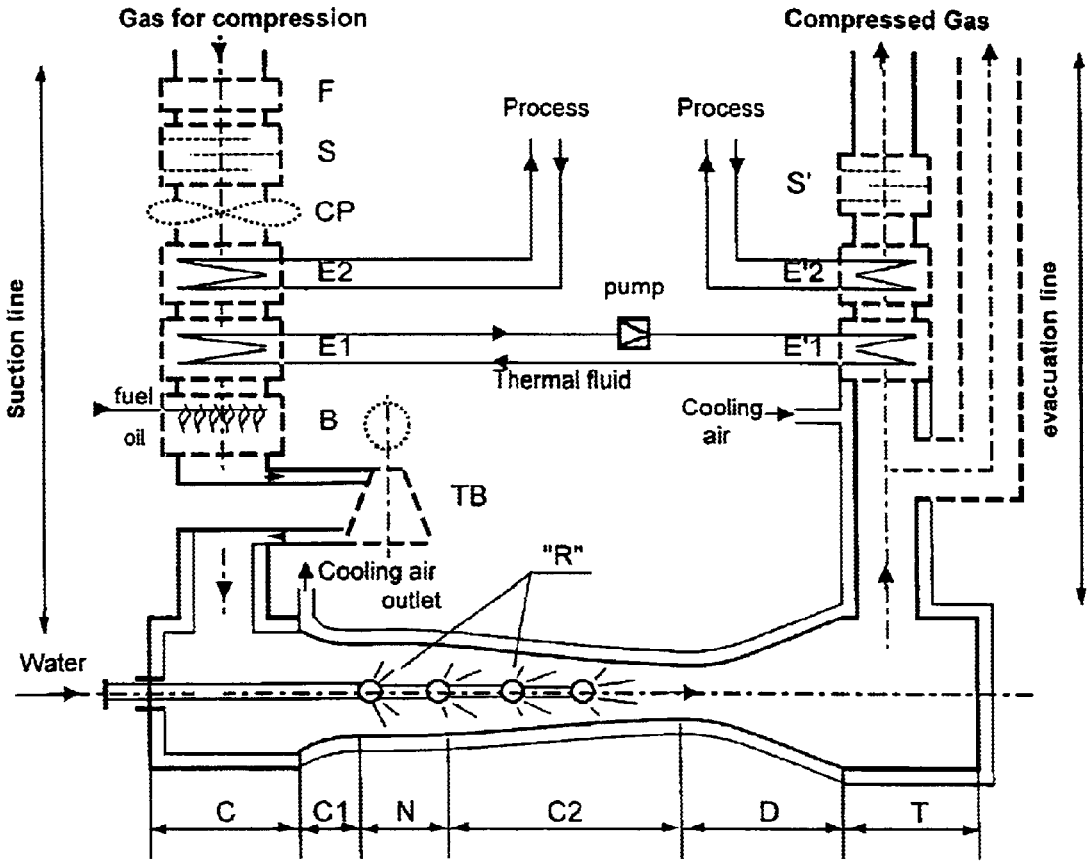
FIGURE 1
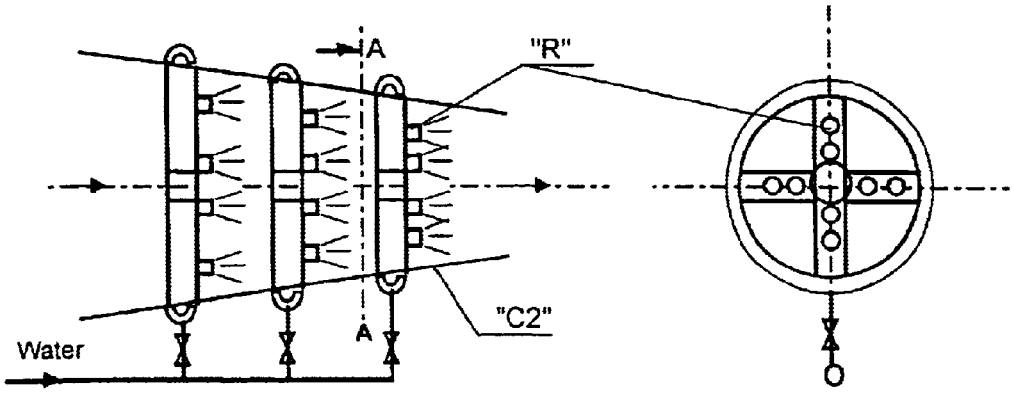
FIGURE 1.1

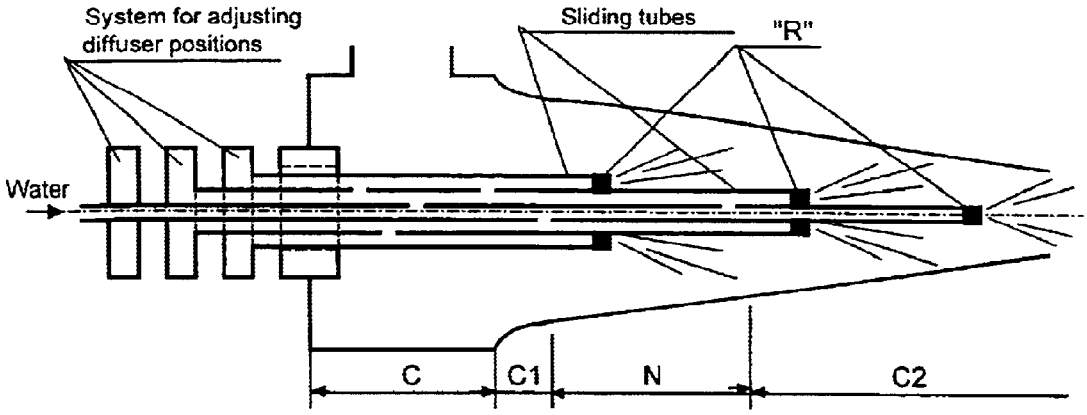
FIGURE 1.2
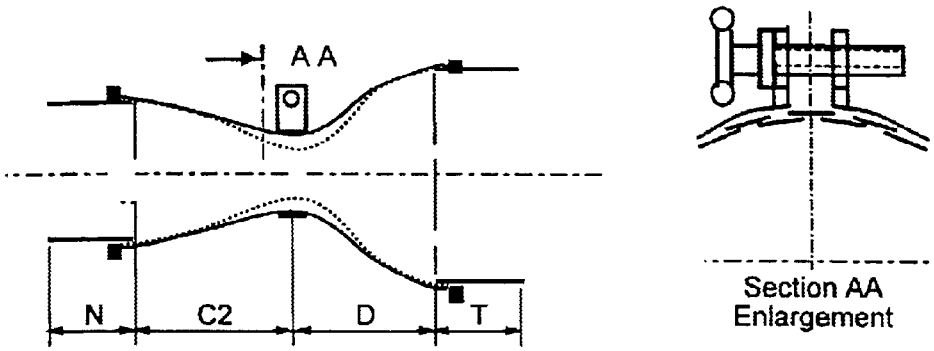
FIGURE 2.1
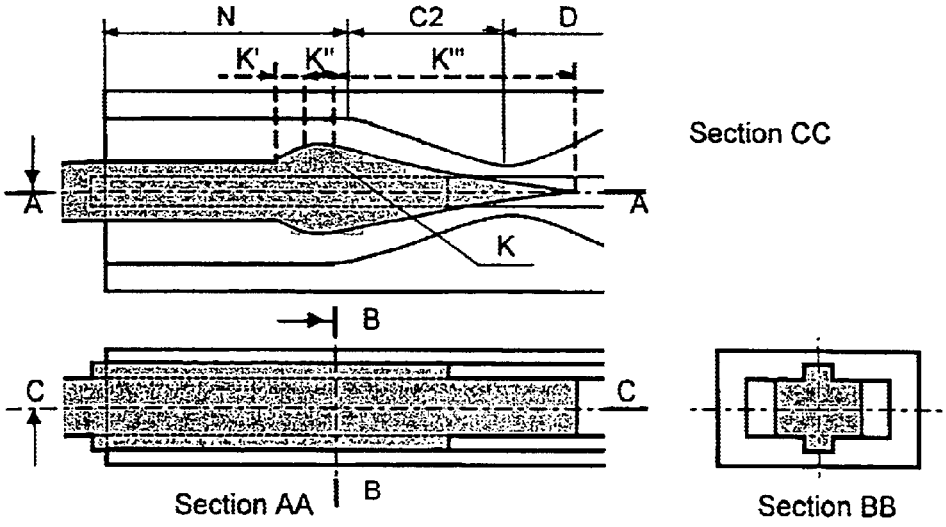
FIGURE 2.2

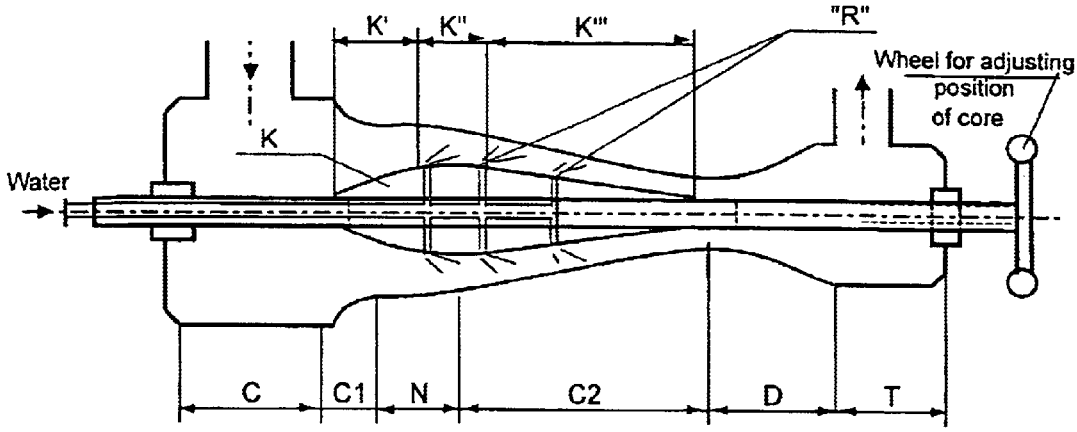
FIGURE 2.3
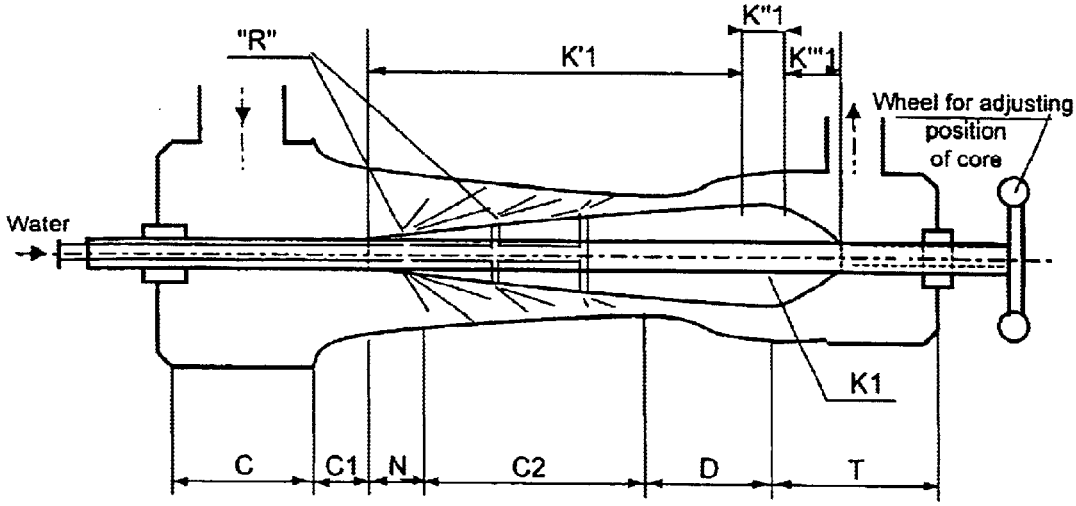
FIGURE 2.4

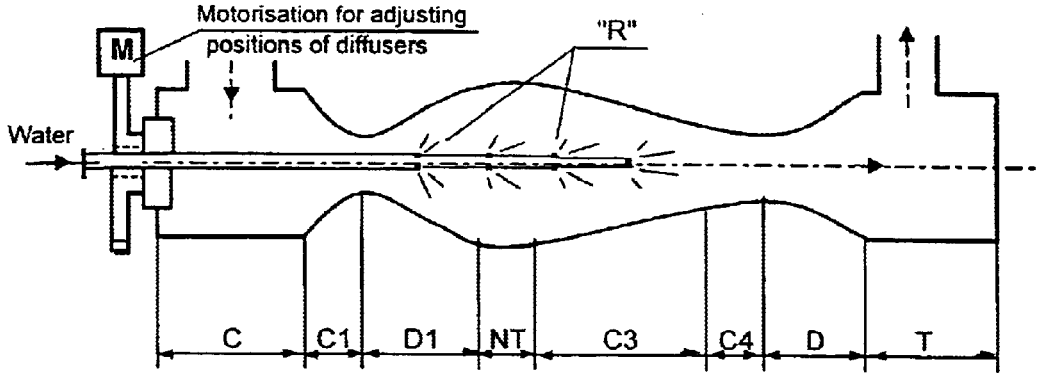
FIGURE 3
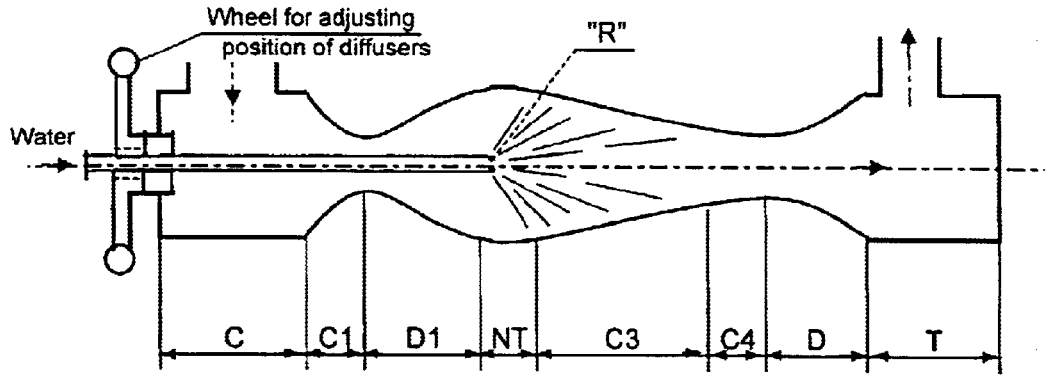
FIGURE 4
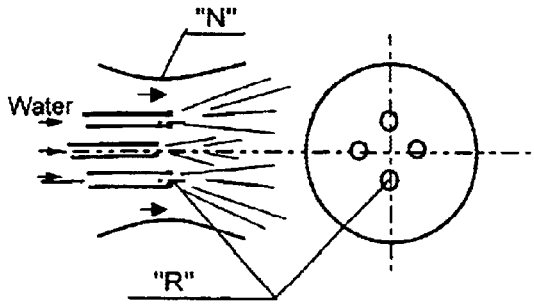
FIGURE 4.1
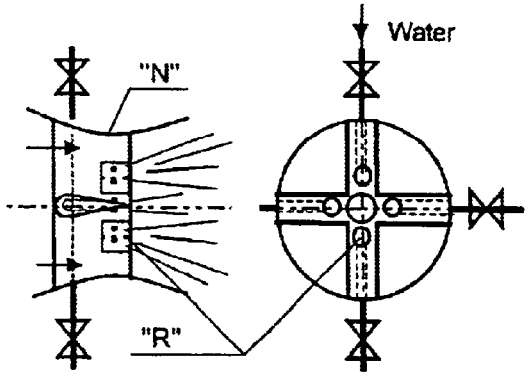
FIGURE 4.2

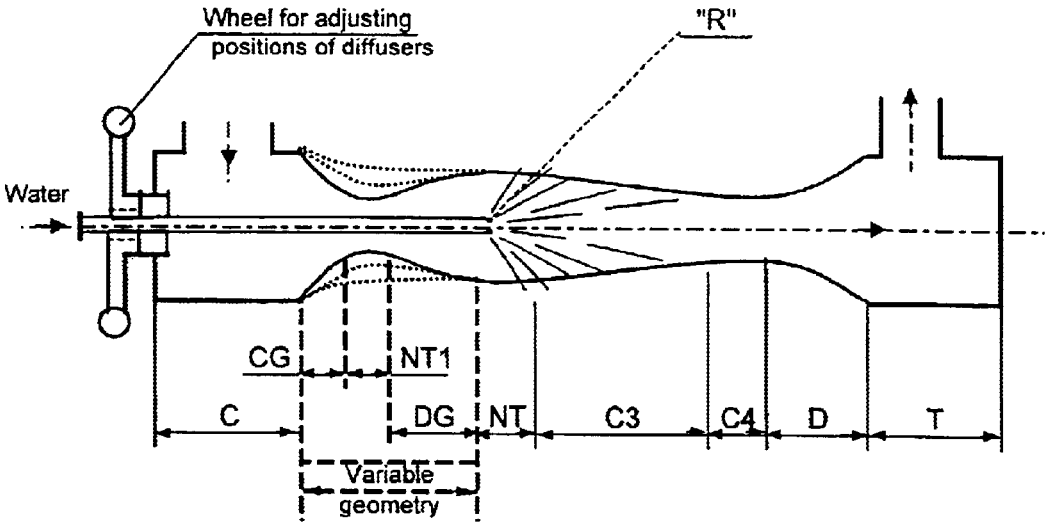
FIGURE 5
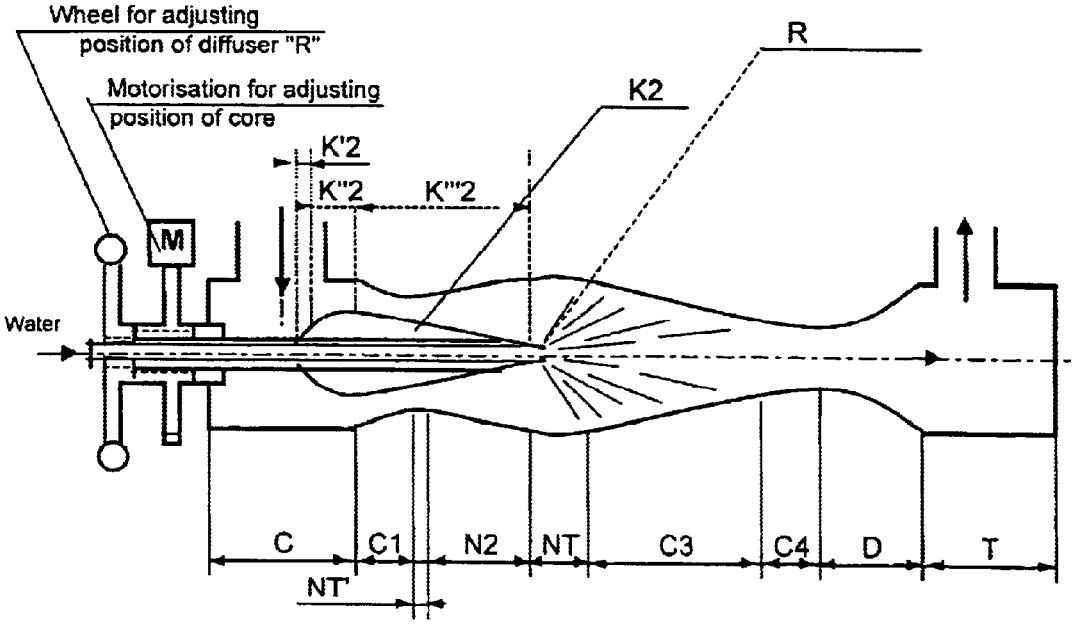
FIGURE 5.1

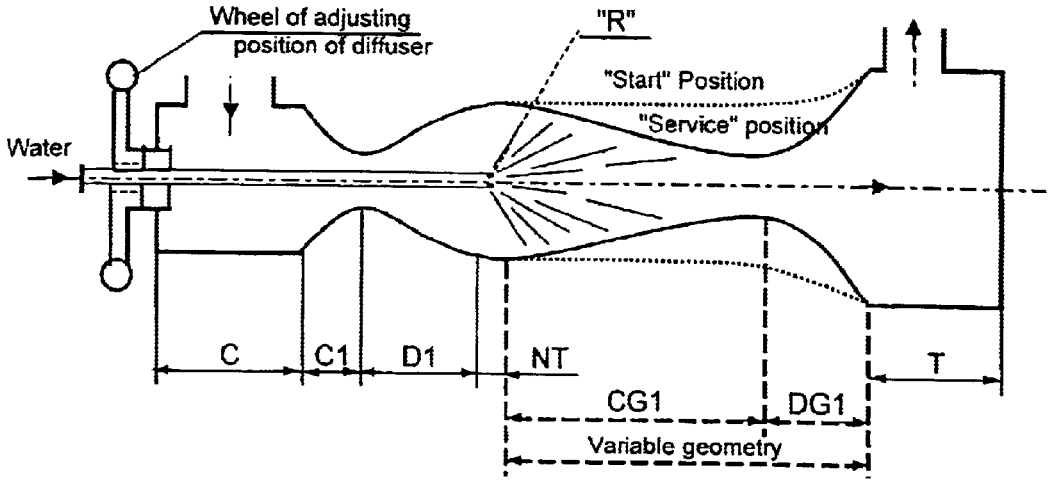
FIGURE 6
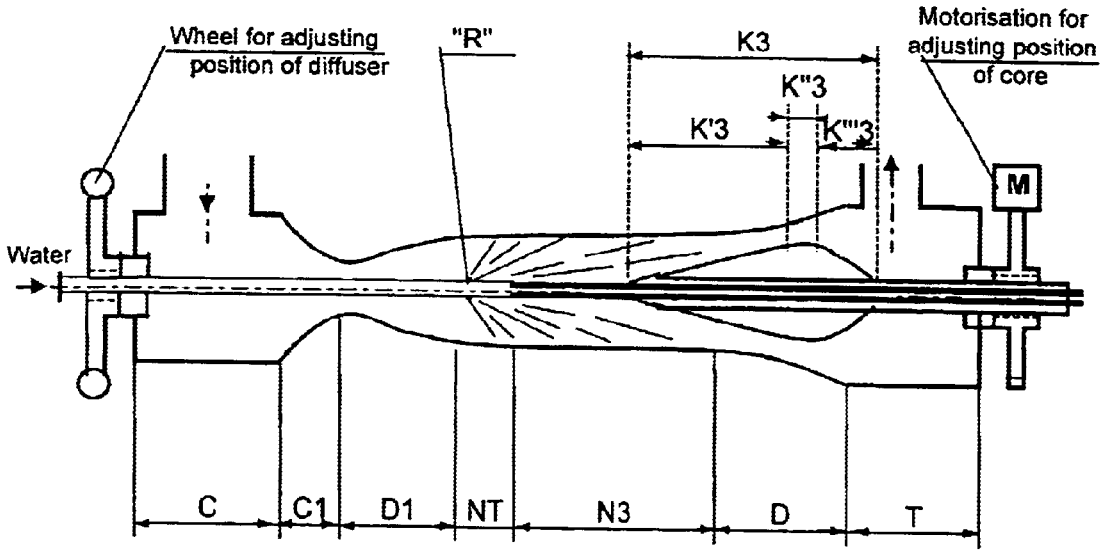
FIGURE 6.1

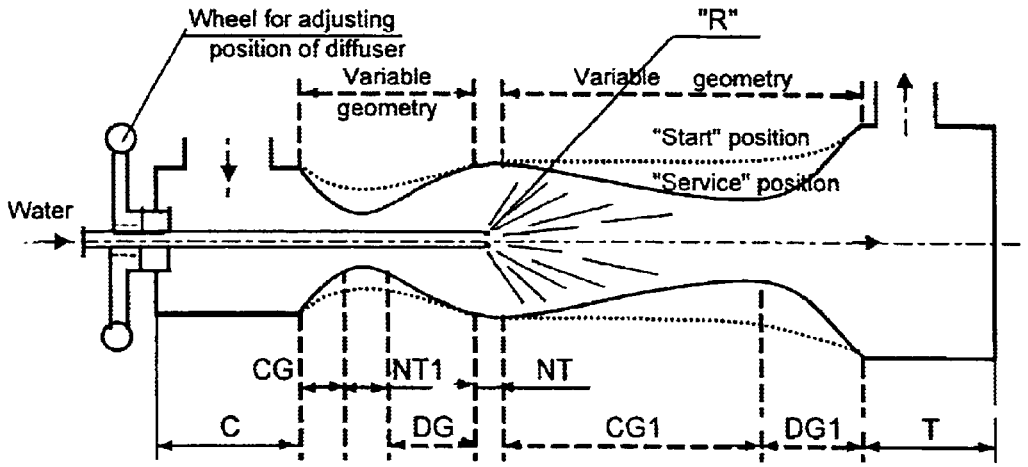
FIGURE 7
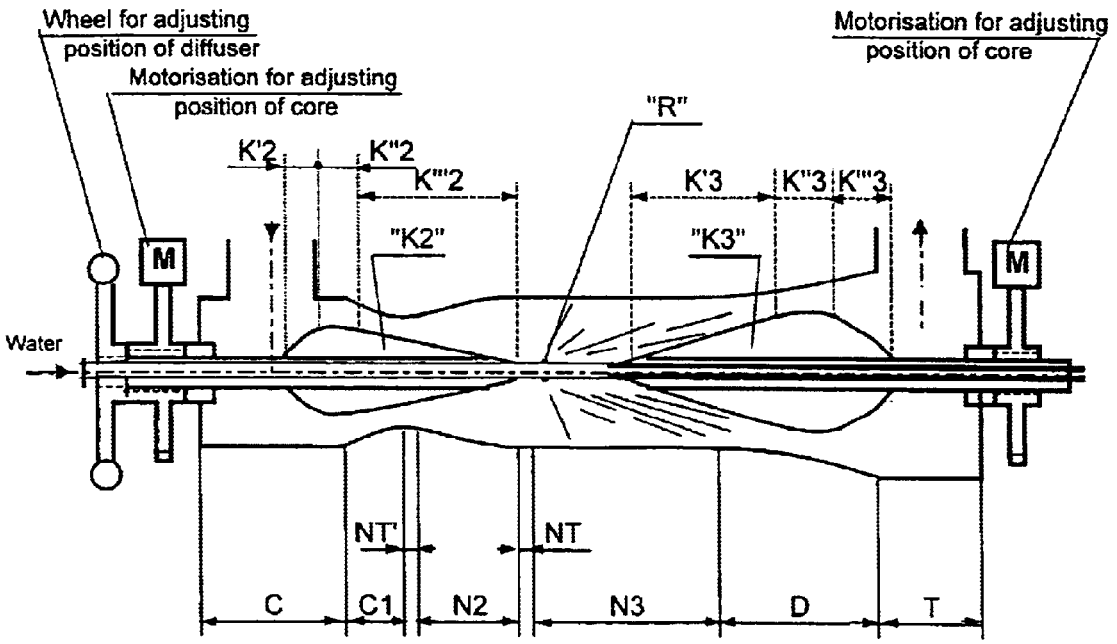
FIGURE 7.1

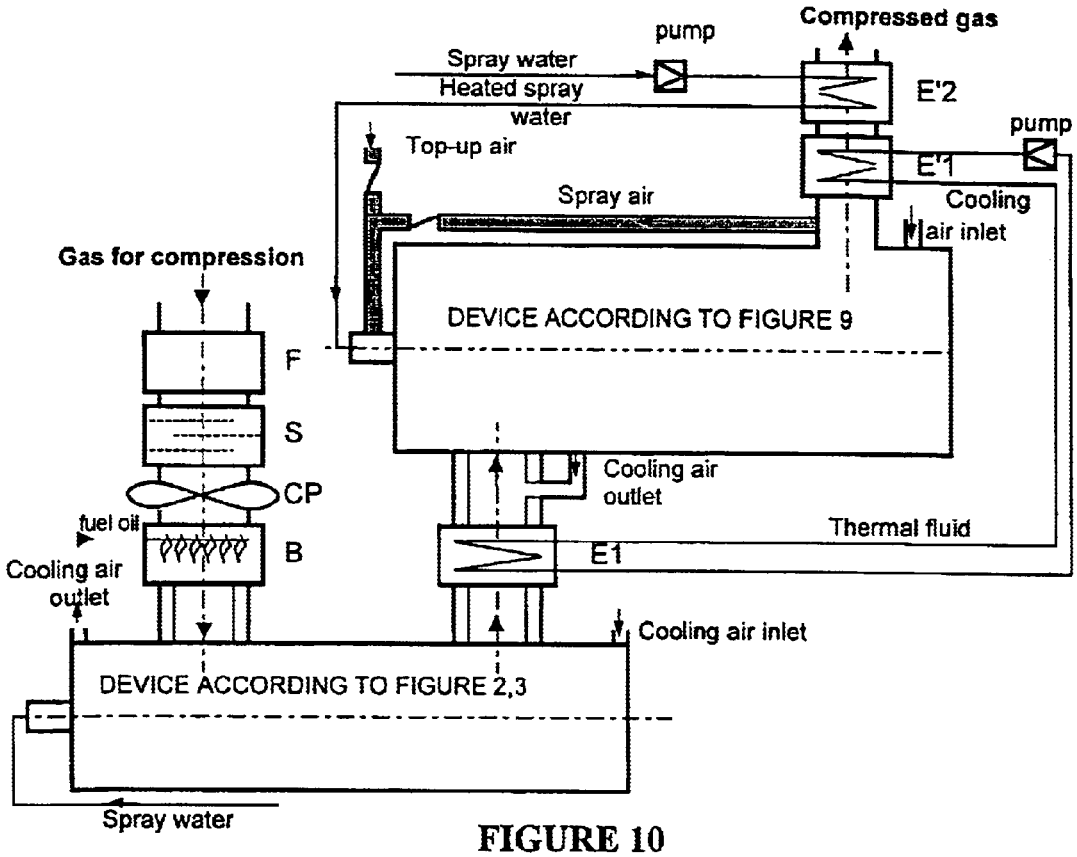
FIGURE 10
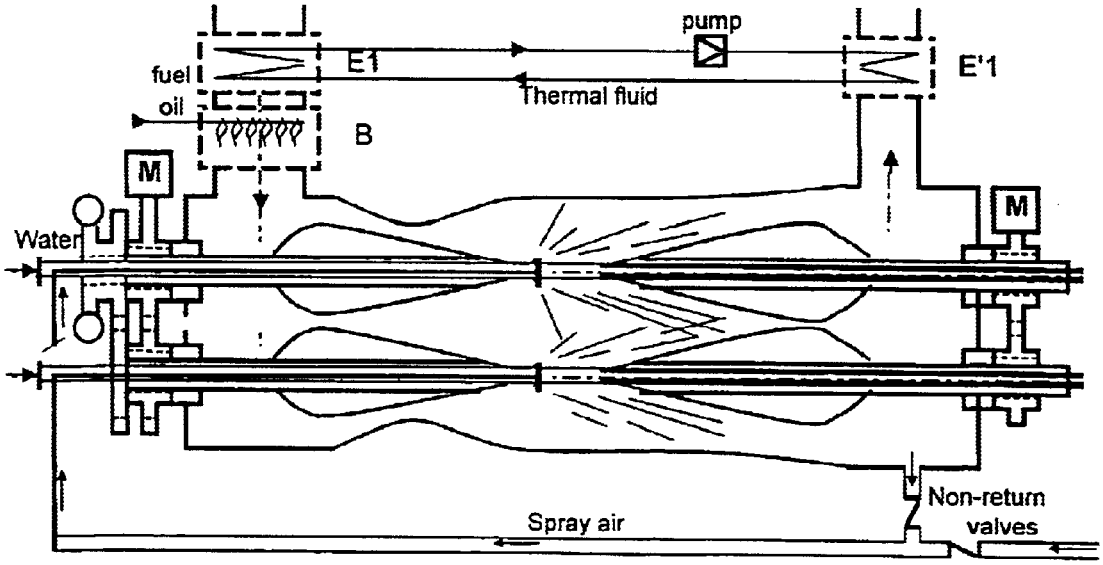
FIGURE 10.1

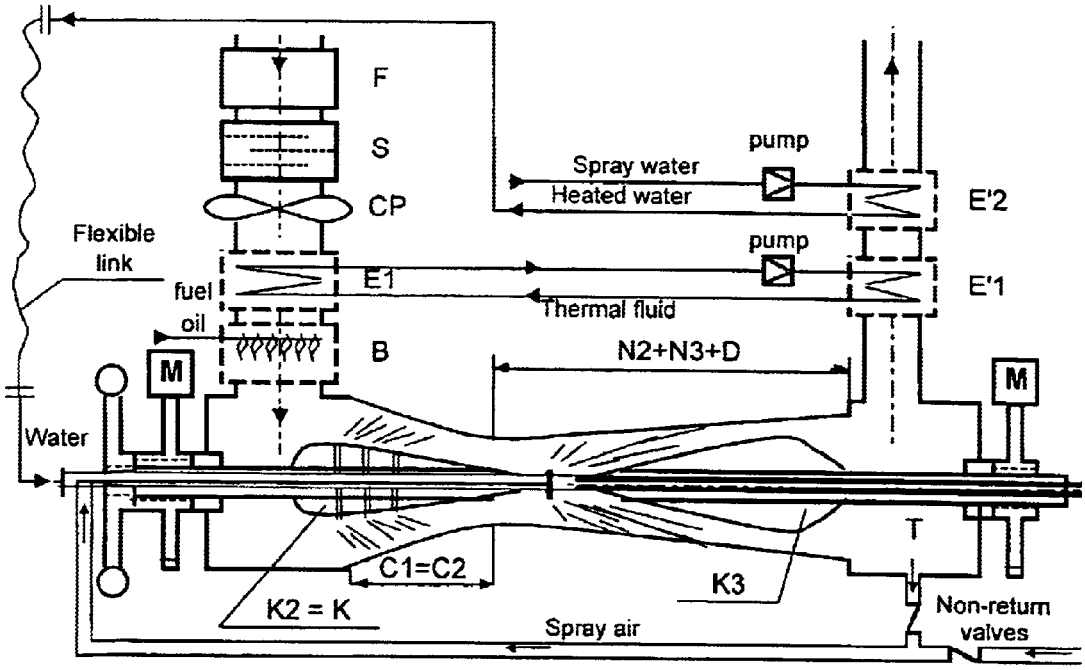
FIGURE 10.2
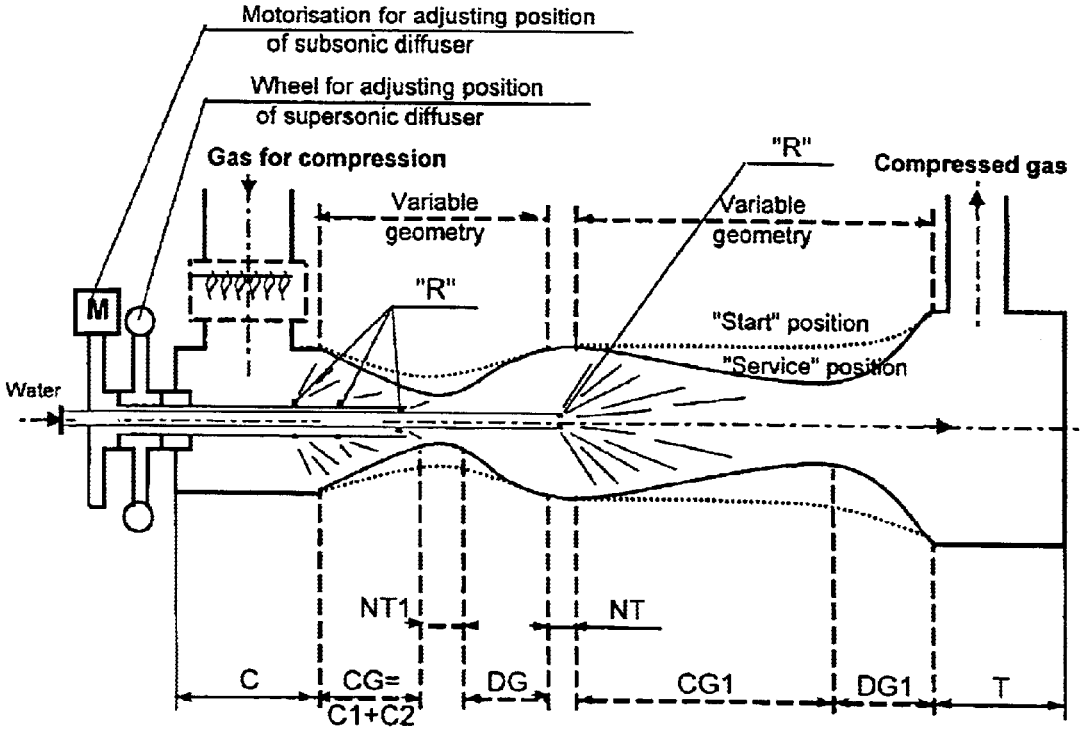
FIGURE 10.3

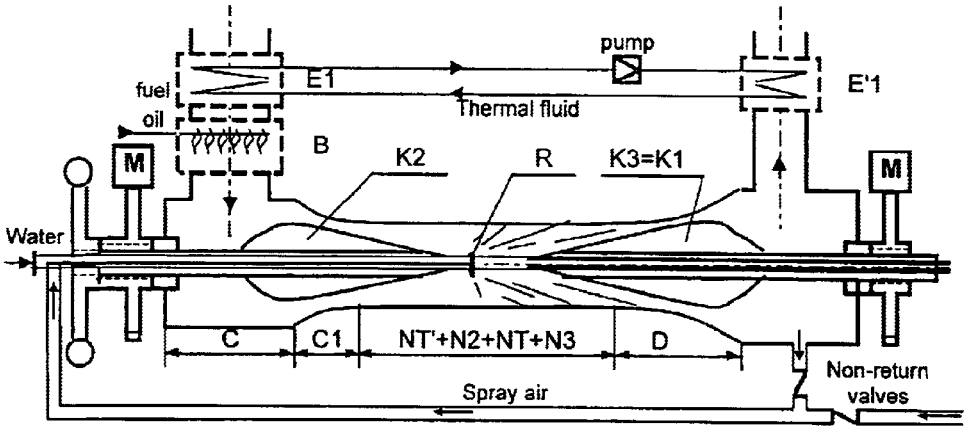
FIGURE 10.4

THERMO-KINETIC COMPRESSOR

BACKGROUND OF THE INVENTION

The present invention concerns a compressor of air or any other gas for a low cost price, in which the primary energy used in the compression cycle is not mechanical or electrical energy as in most compressors, but thermal energy directly; this compressor contains no moving parts subject to wear and tear, and the losses of energy due to friction and the surplus heat from the cold source of the cycle may be recovered and re-used in the compression cycle or to generate pressurized steam which, when mixed with the compressed gas, increases its flow rate.

This device is intended for compression or partial vacuum application of any industrial gas, but its thermal cycle makes it particularly suitable for use in construction of high efficiency thermo-energy plants, in construction of energy economising systems such as mechanical recompression of steam, or for the recovery and reconversion of residual thermal energy.

In the current state of the technology, compressors consist of devices in which the gas compression energy is supplied in the form of mechanical energy: volumetric compressors, centrifugal or axial compressors, etc., or compressors using the potential or kinetic energy of another entraining gas, which is also a form of mechanical energy: ejectors.

In addition, the research report mentions devices of the "ejector" type in which the origin of the mechanical compression energy is the kinetic energy of a entraining gas or liquid, which is the case with patents No. BE537693, GB928661, and EP0514914, or is a device relating solely to mixes of gases without the presence of liquid, which is the case with U.S. Pat. No. 3,915,222, the operation of which is doubtful; the operational principles themselves and the elements constituting these devices cannot be compared to the device forming the subject of the present patent, in which the compression energy is neither mechanical energy or the kinetic energy of a entraining fluid, but solely thermal energy, with indispensable mixing of the gas for compression and a liquid evaporation of which allows the heat to be taken from the cycle's cold source to be absorbed.

Compressors in the current state of the technology require substantial maintenance due to the mechanical friction and the wear and tear which result, and have low energy efficiency levels, or even very low ones in the case of ejectors, due essentially:

To the multiple conversions of energy in the facilities used: Thermal motors or Turbines to convert thermal energy into mechanical or electrical energy, possibly alternators and electric motors to retransform the electrical energy into mechanical energy, and lastly compressors to transfer the mechanical energy to the gas for compression, To the relatively low temperatures used in the first transformation of thermal energy into mechanical energy in power stations, To the reheating of the gas for compression when it is compressed, which inevitably means that the compression is far from being adiabatic, To the mechanical friction and the losses of kinetic energy of the gas for compression, To the non-recovery, in the total cycle, of the thermal energies resulting from the compression, of the losses by friction, and of the cold source of the motor or turbine, To mechanical wear and tear, To deposits and soilings on the air compressors: even frequent washings of the gas turbine compressors can only attenuate the effect of these soilings.

SUMMARY OF THE INVENTION

The device according to the invention, which uses neither mechanical energy nor kinetic entraining energy but only thermal energy to compress the gas, enables most of these disadvantages to be overcome through the use of a different cycle, consisting in pre-processing the gas for compression and in giving it thermal energy directly, in reducing its pressure at sonic or supersonic speed through pressure reduction nozzles, in removing heat at high-speed and thus at low temperature by spraying and controlled evaporation of liquid distributed in a pressure reduction-cooling nozzle, with the nozzle enabling a high speed to be maintained, and finally in recompressing this gas in an adiabatic compression nozzle in order to reduce its speed to a normal outflow value; the pressure reduction nozzles, the pressure reduction and cooling nozzles, and the adiabatic compression nozzles can be fitted with a variable geometry system, enabling the sections of their inlet and/or outlet necks to be adjusted to regulate, among other things, the device's flow and compression rates.

Heat removal at low temperature causes a substantial reduction of entropy in the gas for compression, which leads to a pressure at the outlet of the device which is very much higher than the inlet pressure.

In this device, losses of energy due to losses of charge of the gas for compression and the thermal losses by the walls of the device are reinjected in the form of heat into the gas for compression, reducing in proportion the initial thermal input.

Similarly, the surplus heat from the cold source is removed through the evaporation of the sprayed liquid, which increases in proportion the flow rate of the compressed gas at the outlet of the device; this increase in the flow rate, which may be eliminated at the outlet of the device by condensation, is useful for certain applications of the device, and particularly in the construction of thermal power stations, in which it very advantageously replaces the steam generators in steam-generating power stations and above all in combined cycle power stations.

The shock or compression waves which may possibly be developed in the supersonic part of the outflow may be eliminated or displaced towards the outlet orifice of the device, as described in the variants described in detail below.

BRIEF DESCRIPTION OF THE DRAWINGS

FIG. 1 is schematic representation of a first embodiment of the present invention.

FIG. 1.1 is a schematic representation of a first diffuser arrangement for the embodiment of FIG. 1.

FIG. 1.2 is a schematic representation of a further diffuser arrangement for the embodiment of FIG. 1.

FIG. 2 is schematic representation of a second embodiment of the present invention.

FIG. 2.1 is a schematic representation of a first modification to the embodiment of FIG. 2.

FIG. 2.2 is a schematic representation of a second modification to the embodiment of FIG. 2.

FIG. 2.3 is a schematic representation of a third modification to the embodiment of FIG. 2.

FIG. 2.4 is a schematic representation of a fourth modification to the embodiment of FIG. 2.

FIG. 3 is a schematic representation of a third embodiment of the present invention.

FIG. 4 is a schematic representation of a fourth embodiment of the present invention.

FIG. 4.1 is a schematic representation of a first modification to the embodiment of FIG. 4.

FIG. 4.2 is a schematic representation of a second modification to the embodiment of FIG. 4.

FIG. 5 is a schematic representation of a fifth embodiment of the present invention.

FIG. 5.1 is a schematic representation of a first modification to the embodiment of FIG. 5.

FIG. 6 is a schematic representation of a sixth embodiment of the present invention.

FIG. 6.1 is a schematic representation of a first modification to the embodiment of FIG. 6.

FIG. 7 is a schematic representation of a seventh embodiment of the present invention.

FIG. 7.1 is a schematic representation of a first modification to the embodiment of FIG. 7.

FIG. 10 is a schematic representation of a tenth embodiment of the present invention.

FIG. 10.1 is a schematic representation of a first modification to the embodiment of FIG. 10.

FIG. 10.2 is a schematic representation of a second modification to the embodiment of FIG. 10.

FIG. 10.3 is a schematic representation of a third modification to the embodiment of FIG. 10.

FIG. 10.4 is a schematic representation of a fourth modification to the embodiment of FIG. 10.

DESCRIPTION OF THE PREFERRED EMBODIMENTS

Basic Version 1

Figure 8:
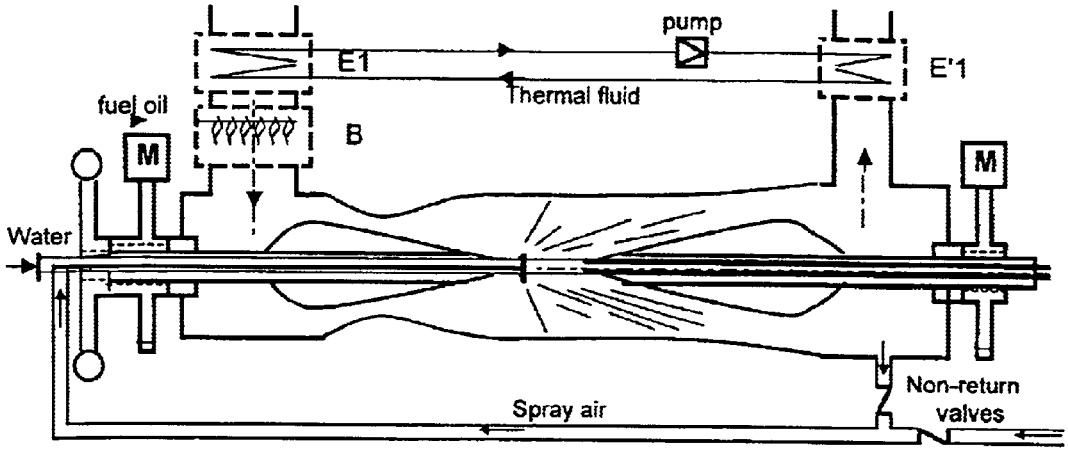
FIG. 8 is a schematic representation of an eighth embodiment of the present invention.

It its simplest concept, which we shall call Basic Version 1, represented by FIG. 1, the device according to the invention uses a subsonic or sonic outflow; it contains a suction line equipped for pre-treating and reheating the gas for compression, an optional inlet chamber (C) intended to calm the gaseous flow before its admission into a pressure reduction mixer head (C1) enabling its speed to be increased possibly to that of sound, a transition zone (N), a convergent Pressure Reduction/Cooling nozzle (C2), a cooling system (R) consisting of a set of water (or other liquid) spraying diffusers, with flow rate and/or position adjustable from outside the device arranged along zones (N) and (C2), and intended to extract heat from the gas for compression by evaporation of the injected liquid, and finally an adiabatic compression mixing tube (D) intended to compress the gas by reducing its speed to a normal outflow speed of around 10 to 50 m/s before it is admitted into a calming chamber (T), and expelled into an evacuation duct.

The transition zone (N) provides a continuous link between the ends of (C1) and (C2) with a generator with monotonic slope, without comers.

The suction device is fitted with elements enabling the gas for compression to be heated, such as: Thermal exchangers (E1), (E2), . . . (En) using, directly or with the assistance of an intermediate fluid, the residual heat contained in the compressed gas at the outlet of the device or any other source of heat available elsewhere, Bumer (B) supplied with fuel, pressure reduction turbine (TB); these elements are intended to heat the gas for compression if its temperature is not sufficiently high when entering the device; As required for the purpose for which the gas for compression is intended, the suction device may be fitted with additional elements, such as: A suction Filter (F), a Silencing device (S), a Primary Compressor (CP), for use in bringing the device into service.

Similarly, depending on the context in which the device is to be used, the evacuation duct may be fitted with elements such as: Systems for recycling hot gases, Exchangers (E'1), (E'2), . . . , (E'n) enabling the residual heat contained in the device's compressed gas to be recovered, a Silencing device (S'); it is possible for this equipment to be supplied only by a part of the compressed gas, and it may be installed downstream from a burner and a turbine if the device is intended for the production of mechanical or electrical energy.

Heating of the gas upstream from (C) enables it to be superheated to distance its temperature from the temperature of saturation with the sprayed liquid; depending on the desired compression rate and efficiency, the superheating temperature may range from 100° C. to over 1500° C.

When it flows out into the convergent Pressure Reduction/Cooling convergent nozzle (C2), the gas is reduced in pressure at each moment and accelerated in the convergent nozzle, and simultaneously cooled by evaporation of the sprayed liquid, which causes it to contract in a sonic or subsonic regime and thus its speed to fall with a fall of entropy and increase of pressure, which attenuates or eliminates the tendency to increase speed due to the mixer head: distribution of the spraying and evaporation along neutral zone (N) and nozzle (C2) enables a balance to be achieved between the tendencies to increase and reduce the speed, and thus to remove heat whilst maintaining optimal sonic or subsonic speed throughout the axis of (C2).

To this end, the cooling system (R) enables the cooling distribution along the axis of (C2) to be adjusted by any means allowing the adjustment of the flow rate and of the position of each diffuser; an example of embodiment, represented in FIG. 1.1, shows diffusers arranged in radial blades distributed along the axis of (C2), with the possibility of adjusting manually or automatically from outside the flow rate of liquid injected in each row of diffusers using external valves; a second example of preferential embodiment, represented in FIG. 1.2, shows spray diffusers distributed along the axis of the device in zones (N) and (C2) and arranged at the end of concentric tubes sliding axially; the tubes are supported by threaded bearings at the end of the inlet chamber, in which the threads enable the position of each spray diffuser to be adjusted manually or automatically from outside; external valves enable the flow rate of each diffuser to be adjusted.

The device may naturally be designed with a single spray diffuser, but this then leads to reduced efficiency.

In order to reduce the length of zone (C2) and thus to reduce the losses of charge of the gas for compression through the device, the spray diffusers chosen should preferably be diffusers with a high injection speed and with minimum droplet dimensions, such as high-pressure diffusers, assisted by means of compressed air or steam, and possibly by means of ultra-sound or microwaves.

For (C) inlet gas temperatures at under 300° C., parts (C), (C1), (N), (C2), (D) and (T) may be made from carbon steel, stainless steel, or any other material compatible with the gas for compression with high mechanical resistance and high abrasion resistance at 300° C.; in the case of gas temperatures at the inlet of (C) above 300° C., these parts may, for example, be made from carbon steel covered on the inside with heat insulator or a refractory, carbon or stainless steel with a twin envelope cooled with water or the gas for compression, ceramic material, or any other material with high mechanical resistance and high abrasion resistance at high temperatures.

As an example of embodiment, the device according to FIG. 1 enables nearly 30,000 Nm3/hour of air to be compressed from 1 bar A to 2.5 bar A, using the following elements:

An air suction line of diameter less than 0.6 m made from carbon steel, including a primary start-up compressor capable of developing overpressure of 100 mbar and a burner operating with natural gas with an internal covering of the suction line made from refractory concrete in the burner and downstream from it; the burner enables the air to be preheated to a temperature close to 1200° C.

A cylindrical inlet chamber (C) of length 1.5 m and diameter around 1.2 m

A cylindrical pressure reduction mixer head (C1) of length 0.6 m and outlet diameter 0.6 m A cylindrical transition zone (N) of diameter 0.6 m and length 0.3 m A nozzle (C2) of inlet diameter 0.6 m, of outlet diameter around 0.35 m and total length around 1 m A mixing tube (D) of inlet diameter 0.35 m and length 0.3 m A calming chamber (T) of diameter 0.6 m and length 0.7 mn A thermal exchanger between the compressed air output from (T) and the suction air.

Inlet chamber (C) is made from carbon steel covered on the inside with refractory concrete, whereas (C1), (N), (C2), (D) and (T) are made from carbon steel with a twin envelope cooled by circulation of the air for compression before it enters the air suction device; the spray diffusers, which are installed on—and supplied by—a system of concentric sliding carbon steel tubes of external diameter 60 mm traversing the inlet chamber, are distributed in (C2) and enable nearly 4.7 kg/second of water to be injected at 200 m/second with average droplet dimensions close to 10 $\mu$m.

Variant 2

A variant 2, concerning a sonic or subsonic outflow, represented in FIGS. 2.1, 2.2, 2.3 and 2.4, enables the flow rate of the gas for compression, the compression rate and the energy efficiency of the device to be adjusted. In this variant, the pressure reduction/cooling nozzle (C2) and the adiabatic compression mixer head (D) of basic version 1 are replaced by a convergent nozzle and a divergent nozzle, both with variable geometry, which enables the outlet section of (C2) and the inlet section of (D) to be adjusted, and thus the section of the neck between (C2) and (D); the variable geometry system, which is controlled from outside the device, is obtained by any mechanism allowing the passage section of the device's neck to be modified, such as the use of deformable walls in nozzles (C2) and (D) as shown in the example of FIG. 2.1, or the addition of a profiled core (K) or (K1), able to slide axially in zones (N), (C2), and (D), and fixed on a shaft traversing one or both ends of the device allowing the position of the core to be adjusted from outside as in the examples of FIGS. 2.2, 2.3 and 2.4.

The example in FIG. 2.1 concerns a nozzle of circular section with deformable walls; zone (C2) and zone (D) consist of overlapping flexible steel strips regularly arranged on the generators of the device, and their ends are welded on to the edges of transition zone (N) and of the calming chamber; circular tightening collars or any other system, such as jacks, etc., enable the device's central section to be modified, which then constitutes the neck of zones (C2) and (D).

The other elements of the device are identical with those described in basic version 1.

The example of embodiment represented in FIG. 2.1 has the same performance specifications as the previous example concerning basic case 1, with the possibility of modifying the flow and compression rates of the gas for compression.

The example in FIG. 2.2 concerns a nozzle of rectangular section; it is fitted with an adjustable system consisting of a core (K) sliding axially in zones (N), (C2) and (D), the axis of which is fixed on to a shaft traversing one or both of the ends of the device; the axial position of core (K) may be adjusted manually or automatically from outside by a thread positioned on a bearing, by an external jack, or by any other external system.

The spray diffusers are distributed in zones (N) and (C2).

The other elements of the device are identical with those described in basic version 1.

Core (K) is a part of rectangular section two opposite sides of which parallel to the axis are juxtaposed with the sides of the nozzle; the two other sides of the core have an aerodynamic profile enabling the losses of charge of the gas for compression to be minimized; each of them consists of an upstream part (K') of constant section, or section increasing in the gas outflow direction, a downstream part (K'''), of section decreasing in the gas outflow direction, and an intermediate part (K''), the continuous profile of which, which has no corner, links the generator of (K') and that of (K''').

Parts (K''') of core (K) slide in the neck between the pressure reduction/cooling nozzle (C2) and the adiabatic pressure reduction mixing tube (D).

Depending on the application sought for the device, and depending on the temperatures of the gas for compression on entry into the inlet chamber (C), the core (K) may be made from carbon steel for temperatures under 300° C., stainless steel, steel cooled by internal circulation of cooling fluid, ceramic material, or any other material with satisfactory properties when subject to the abrasion and temperatures applied.

The example in FIG. 2.3 concerns a device of circular section; it is fitted with an adjustable system consisting of a core (K) sliding axially in zones (N), (C2) and (D), where the core is fixed on to a shaft traversing one or both of the ends of the device; the axial position of core (K) may be adjusted manually or automatically from outside by a thread positioned on a bearing, by an external jack, or by any other external system.

The spray diffusers are distributed in zones (N) and (C2).

The other elements of the device are identical with those described in basic version 1.

Core (K) is a fully revolving part the aerodynamic profile of which enables the losses of charge of the gas for compression to be minimized; it consists of an upstream part (K') of constant section or section increasing in the gas outflow direction, a downstream part (K''') of section decreasing in the gas outflow direction, and an intermediate part (K'') the continuous generator of which (without comers) links the generator of (K') and that of (K''').

Part (K''') of the core (K) slides in the neck between the pressure reduction/cooling nozzle (C2) and adiabatic pressure reduction mixing tube (D).

Depending on the application sought for the device, and depending on the temperatures of the gas for compression on entry into the inlet chamber (C), the core (K) may be made from carbon steel for temperatures under 300°, stainless steel, steel cooled by internal circulation of cooling fluid, ceramic material, or any other material with satisfactory properties when subject to the abrasion and temperatures applied.

The example of embodiment represented in FIG. 2.3 shows a shaft traversing (K) and supported by a bearing placed in the inlet chamber, and by a second bearing at the end of the calming chamber (T), the latter including a thread for adjusting the position of the core and the spray diffusers.

When the gas for compression flows out into the pressure reduction/cooling mixer head (C2), the free space between (K''') and (C2) constitutes a convergent nozzle which plays the same role as the convergent compression/cooling nozzle (C2) described in variant 1; the neck, i.e. the minimal passage section, of this convergent nozzle, is located slightly upstream from the output neck of (C2), and its section Ss may be modified at any time from outside by adjusting the axial position of core (K).

This adjustment of section Ss in the neck, accompanied by an adjustment of the flow rate of the sprayed liquid, enables the flow rate of the fluid for compression to be modified, or alternatively the compression rate and the energy efficiency rate of the device to be modified by modification of the gas heating temperature when it enters the inlet chamber.

The example of embodiment represented in FIG. 2.3 has the same performance specifications as the previous example concerning basic case 1, with the following modifications enabling the flow and compression rates of the gas for compression to be adjusted:

The diameter of the transition zone (N) becomes 0.45 m,

The inlet and outlet diameters of the convergent pressure reduction/cooling nozzle (C2) become respectively 0.45 m and 0.22 m, The inlet diameter of mixing tube (D) becomes 0.22 m, Addition of a stainless steel core (K) cooled by internal circulation of water of maximum diameter 0.3 m, of minimum diameter 0.1 m, at the outlet from (K''') and of total length 1.0 m, with position adjustment thread.

The example of FIG. 2.4 also concerns a device of circular section; the principle is identical to that of variant 2.3, but in this case the core is installed downstream from the device.

The device is fitted with a core (K1) sliding axially in zones (N), (C2), (D) and (T), the axis of which is fixed on to a shaft traversing one or both of the ends of the device; the axial position of core (K1) may be adjusted manually or automatically from outside by a thread positioned on a bearing, by an external jack, or by any other external system.

The spray diffusers are distributed in zones (N) and (C2).

The other elements of the device are identical with those described in basic version 1.

Core (K1) is a fully revolving part the aerodynamic profile of which enables the losses of charge of the gas for compression to be minimized; it consists of an upstream part (K'1) of constant section or section increasing in the gas outflow direction, a downstream part (K'''1) of constant section or section decreasing in the gas outflow direction, and an intermediate part (K''1) the continuous generator of which, without comers, links the generator of (K'1) and that of (K'''1).

Part (K'1) of the core slides in the neck between pressure reduction/cooling nozzle (C2) and adiabatic pressure reduction mixing tube (D).

Depending on the application sought for the device, and depending on the temperatures of the gas for compression on entry into the inlet chamber (C), core (K1) may be made from carbon steel for temperatures under 300°, stainless steel, steel cooled by internal circulation of cooling fluid, ceramic material, or any other material with satisfactory properties when subject to the abrasion and temperatures applied.

The example of embodiment represented in FIG. 2.4 shows a shaft traversing core (K1) from side to side and resting on bearings placed in the inlet chamber and in the calming chamber, with the latter including a position adjustment thread.

When the gas for compression flows out into zone (C2), the free space between (K1) and duct (C2) constitutes a convergent nozzle which plays the same role as convergent compression/cooling nozzle (C2) described in basic version 1; the neck, i.e. the minimal passage section downstream from this convergent nozzle, is generally located downstream from the output neck of (C2), and its section Ss may be modified at any time from outside by adjusting the axial position of core (K1).

This adjustment of section Ss in the neck, accompanied by an adjustment of the flow rate of the sprayed liquid, enables the flow rate of the fluid for compression to be modified, or alternatively the compression rate and the energy efficiency rate of the device to be modified through a modification of the heating temperature of the gas when it enters the inlet chamber.

As an example of embodiment, the device represented in FIG. 2.4 has the same performance specifications as the example of embodiment concerning basic case 1, with the following modifications enabling the flow and compression rates of the gas for compression to be adjusted:

The inlet and outlet diameters of the convergent pressure reduction/cooling nozzle (C2) become respectively 0.60 m and 0.36 m, The inlet diameter of the mixing tube (D) becomes 0.36 m, and its length becomes 0.5 m Addition of a core (K) made of stainless steel cooled by internal circulation of water of maximum diameter 0.35 m, of minimum diameter 0.07 m at the inlet of (K') and at the outlet of (K'''), of total length 1.0 m, supported by a shaft of diameter 70 mm resting on bearings installed in (C) and in (T), with a thread for adjusting its position.

The system of spray diffusers is identical to that of the example of embodiment of basic case 1, but the sliding tubes are housed in the core support shaft.

Variant 3

A variant 3, concerning a supersonic outflow in the cooling zone, is represented in FIG. 3; it enables the energy efficiency of the device as described in basic version 1 to be improved by obtaining a large temperature difference of the fluid between its entry into the inlet chamber (C) and the cooling zone.

The modifications compared to basic version 1 concern firstly use of pressure reduction mixer head (C1), in which the fluid for compression has its pressure systematically reduced to sonic speed, and secondly the replacement of transition zone (N) and of nozzle (C2) by a supersonic divergent pressure reduction nozzle (D1), followed by a transition zone (NT), a convergent compression/cooling nozzle (C3), and a convergent adiabatic compression nozzle (C4); the system of spray diffusers (R), which is identical to that of basic version 1, is installed in zone (C3) and possibly, as described below, in zones (D1) or (NT).

Transition zone (NT) continuously links the ends of (D1) and (C3) with a generator with monotonic slope, without corners.

The other elements of the device are identical with those described in basic version 1.

The fluid for compression is heated upstream from zone (C) to a temperature which may substantially exceed 1000 to 1500° C., and then its pressure is reduced throughout zones (C1) and (D1), which constitute a convergent/divergent supersonic pressure reduction nozzle with sonic speed in the neck until a pressure Pa, a speed Va and a temperature Ta, and finally compressed lo with the temperature being raised in the convergent compression/cooling nozzle (C3) with, simultaneously in the same nozzle (C3), beat being removed by evaporation of the sprayed liquid; convergent adiabatic compression nozzle (C4) enables the fluid to be reduced to sonic speed before its subsonic adiabatic compression in adiabatic compression mixing tube (D) and before being evacuated.

The spray system consists of a series of diffusers the positions and/or flow rates of which may be adjusted manually or automatically from outside, along the same lines as basic version 1; heat removal by evaporation of the sprayed droplets may be undertaken in zone (D1); the cycle then comes close to isobar cooling, but this case is of little practical interest: we shall mention in the remainder of the description only the heat removal undertaken in zones (NT) or (C3) with a cycle close to isothermal transformation, with the spray diffusers distributed in zone (C3) and possibly, by anticipation, in transition zone (NT) to take account of the time delay between spraying and evaporation.

The theoretical energy efficiency of the device is all the higher because the temperature of the gas for compression at the inlet to (C) is high and the pressure reduction temperature Ta is low, although the latter remains higher than the saturation temperature Ts of the gas in relation to the sprayed liquid since the temperature difference DT=Ta−Ts is necessary for evaporation of the sprayed liquid at the inlet to zones (NT) and (C3); in the special case in which Ta is lower than Ts, the evaporation of the sprayed liquid, and thus the heat removal in the gas for compression, will begin in (C3) only when, under the effect of the compression, the actual temperature of the gas has exceeded its saturation temperature.

The evaporation of the sprayed liquid and the heat removal in zones (NT) and (C3) will be all the more rapid because the sprayed droplets are small in size, and the temperature difference DT=Ta−Ts is high, and the direct consequence will be a reduction in the length of (C3) and a reduction in the loss of charge of the gas for compression through (C3); in practice, droplet dimensions of the order of 5 to 30 $\mu$m, and temperature differences DT=Ta−Ts of the order of 10° C. to 100° C., produce perfectly acceptable device dimensions and losses of charge of the gas through (C3).

Dimensioning of the device naturally depends firstly on the flow rate and characteristics of the gas for compression, together with the sought output pressure; since these criteria are fixed, the choices of gas heating temperature upstream from (C), the pressure reduction rate through (C1) and (C2), and the droplet dimensions, result from a compromise between the standard facilities available on the market: types of spray diffusers, materials, etc, and between the dimensions and price of the device, and its energy efficiency.

As an example of embodiment, an air compressor consisting of the device according to FIG. 3 enables nearly 20000 Nm3 per hour of air to be compressed from 1 bar A to 1.5 bar A, sing the following elements:

An air suction device of internal diameter 0.47 m made of carbon steel and covered internally with refractory concrete with a primary starter compressor capable of developing an overpressure of 500 mbar and a burner operating with natural gas and enabling air to be heated to 1000° C., an inlet chamber (C) of diameter 0.97 m and length 1.16 mn a subsonic pressure reduction nozzle (C1) of neck diameter close to 0.295 m, and length 0.670 m, a supersonic pressure reduction divergent nozzle (D1) of inlet diameter close to 0.295 m, of outlet diameter close to 0.388 m, and of length 0.2 mn in which the air pressure is reduced to 0.1 bar A at nearly 370° C. and 1160 m/s, a convergent compression/cooling nozzle (C3) and a convergent adiabatic compression nozzle (C4) of inlet diameter close to 0.388 m, of neck diameter close to 0.209 m, and of length 1 m, an adiabatic compression mixing tube (D) of inlet diameter 0.209 m, of outlet diameter around 0.7 m and total length around 1 m, a calming chamber (T) of diameter 0.7 m and length 0.84 m, a system of ultrasonic spray diffusers with assistance by compressed air, capable of spraying 1.22 kg per second of water, with a droplet diameter of close to 5 $\mu$m, a thermal exchanger enabling the compressed air to be cooled on exit from (T), and the air to be heated before it enters (C) at nearly 480° C.

The inlet chamber (C) is made from carbon steel covered internally with refractory concrete, whereas (C1), (D1), (C3), (C4), (D) and (T) are made from carbon steel with a twin envelope cooled by circulation of the air for compression before its entry into the air suction device; the ultrasonic spray diffusers, which are installed—and supplied by—a system of concentric sliding carbon steel tubes of external diameter 40 mm traversing the inlet chamber, are distributed in (C3).

Variant 4

A variant 4, also concerning a supersonic outflow, is represented in FIG. 4, it derives from variant 3 and enables its concept to be simplified by replacing the system of spray diffusers distributed along the axis of the device by a single axial diffuser or by radial diffusers, placed at the inlet of zone (C) or in transition zone (NT), the latter arrangement enabling the time period between the spray and the evaporation of the injected liquid to be anticipated; the flow rate and the axial position of these diffusers may be adjusted manually or automatically from outside the device.

The other elements of the device are identical with those described for variant 3.

FIG. 4 represents an example of embodiment with a single diffuser located on the axis of the device, at the end of a shaft traversing the inlet chamber, and the flow rate and position of which may be adjusted manually or automatically from outside; FIG. 4.1 represents another example of embodiment with several axial diffusers of the same type, and FIG. 4.2 represents a third example of embodiment with diffusers with adjustable flow rate arranged on radial blades. The example in FIG. 4, which is the most practical one, will be the only one mentioned in the remainder of the description.

In this variant, the entire flow rate of the sprayed fluid is injected at the start of the heat removal cycle, in zone (NT) or at the entrance to (C3); the gas for compression is rapidly saturated at the inlet to (C3) by evaporation of part of the droplets, the remainder of the droplets remaining in suspension in the gaseous flux; as it advances in the compression/cooling nozzle (C3), the gas is compressed, leading its temperature to rise and the previous state of saturation to be left behind, allowing additional vaporization of droplets; this continuous balance enables heat to be extracted from the gas for compression throughout zone (C3) or until total evaporation of the injected droplets, at the same time as the gas for compression is maintained in a state very close to its saturation throughout the axis of (C3); at each point along this axis, the temperature difference DT between the actual temperature of the gas and its saturation temperature will balance out at its minimum, according to the dimensions of the droplets and the thermal exchange and gaseous distribution factors; variant 4 thus enables the thermodynamic cycle of the device to be optimized whilst keeping the cold source at the minimum temperature compatible with the process.

As an example of embodiment, the device represented in FIG. 4 contains the same elements and has the same performance specifications as the example of embodiment in variant 3, except that the system of spray diffusers is replaced by a single axial diffuser.

Variant 5

A variant 5, concerning a supersonic outflow, derives from variants 3 or 4 and enables the flow rate of the gas for compression, the compression rate, and the energy efficiency of the device to be adjusted at any time; in this variant, the mixer head (C1) and the mixing tube (D1) of variants 3 and 4 are replaced by a converging nozzle followed by a divergent nozzle, both with variable geometries, which enables the neck section between these two nozzles to be adjusted; the system of variable geometry, controlled from outside the device, is obtained by any mechanism enabling the neck passage section between (C1) and (D1) to be modified, such as those described in the examples below.

In the example of FIG. 5, the variable geometry system is obtained by replacing (C1) and (D1) by a convergent nozzle (CG) of variable geometry, followed by an optional transition zone (NT) and then by a divergent nozzle (DG), also of variable geometry, all three with deformable walls so as to modify the neck section between the two nozzles; the system of deformable walls may be of the same type as that described in section 2.1 and represented in FIG. 2.1, for example.

Depending on the conditions of use of the device, nozzle (DG) may be fitted with a variable geometry system also enabling it to be slightly convergent, in order to facilitate entry into service of the device under subsonic conditions.

Transition zone (NT1) continuously links the ends of (CG) and (DG) with a generator with monotonic slope, without comers.

Since the speed of the gas for compression must be sonic in the first neck of the device and in the second as far as possible, this possibility of modifying its section enables the temperature and flow rate of the gas for compression to be made mutually independent on exit from the inlet chamber, whilst complying with the sonic outflow constraint in this neck; this enables either the flow rate of the gas for compression, or its temperature, to be modified at the inlet of the first neck—and possibly the flow rate of the sprayed liquid, which leads to a modification of the rate of compression of the device and its efficiency—or both simultaneously.

The other elements of the device are identical with those described in variants 3 or 4.

In the preferential example of FIG. 5.1, the divergent supersonic pressure reduction nozzle (D1) of variants 3 or 4 is replaced by an adjustable system consisting of an optional transition zone (NT) followed by a duct (N2) which is preferably slightly divergent, with the addition of a profiled core (K2) sliding axially in the subsonic pressure reduction mixer head (C1), in transition zone (NT'), and in duct (N2); the core is attached to a shaft traversing for example one or both ends of the device; the axial position of core (K2) may be adjusted manually or automatically from outside the device by a thread mounted on a bearing, by an external jack or by any other system allowing it.

The spray system may be housed in zone (NT), zone (C3) or at the inlet end of (K'''2): see below.

Core (K2) is a part the aerodynamic profile of which enables the losses of charge of the gas for compression to be minimized; it consists of an upstream part (K'2) of constant section or section increasing in the gas outflow direction, a downstream part (K'''2) of section decreasing in the gas outflow direction, and an intermediate part (K"2) the continuous generator of which, without comers, links the generator of (K'2) and that of (K'''2).

Part (K'''2) of core (K2) is housed in subsonic pressure reduction mixer head (C1), in transition zone (NT) and in duct (N2).

Depending on the application sought for the device, and depending on the temperatures of the gas for compression on entry into combustion chamber (C), core (K2) may be made from carbon steel for temperatures under 300°, stainless steel, steel cooled by internal circulation of cooling fluid, ceramic material, or any other material with satisfactory properties when subject to the abrasion and temperatures applied.

The example of embodiment represented in FIG. 5.1 shows a core (K2) supported by a shaft which traverses it axially, itself resting on a bearing placed in the inlet chamber including a position-setting thread; in this example, a single spray diffuser is installed at the inlet end of part (K'''2) of core (K2).

When the gas for compression flows into pressure reduction mixer head (C1), the free space between (K'2) and (C1) constitutes a subsonic pressure reduction convergent nozzle which plays the same role as subsonic pressure reduction convergent nozzle (C1) of variants 4 or 5, and the free space between (K'''2), (NT') and (N2) constitutes, for its part, a supersonic pressure reduction divergent nozzle which plays the same role as nozzle (D1) in variants 3 or 4; the neck, i.e. the minimum passage section between these two nozzles in FIG. 5.1, is generally located between the maximum section of (K2) and the outlet section of (C1), and its section S's may be changed at any time from outside by adjusting the axial position of core (K2).

Depending on the conditions of use of the device, duct (N2) may be slightly convergent, to facilitate the entry into service of the device under subsonic conditions.

As an example of embodiment, a device according to FIG. 5.1 has the same performance specifications as the example of embodiment concerning variant 4, with the following modifications enabling the flow and compression rates of the gas for compression to be adjusted:

Replacement of supersonic pressure reduction mixing tube (D1) by a transition zone (NT) and a divergent nozzle (N2), the combination having an inlet diameter of around 0.295 m, an outlet diameter of around 0.388 m, and a length of 0.2 m, and air pressure in it being reduced to 0.1 bar A; transition zone (NT') and mixing tube (N2) are made from twin envelope carbon steel, Addition of a core (K2) made of stainless steel cooled by internal circulation of water of maximum diameter 0.293 m, minimum diameter 0.04 m at the inlet of (K'2) and at the outlet of (K'''2), total length 0.9 m, supported by a shaft of diameter 40 mm resting on a bearing installed in (C), with a position adjustment thread.

The spray diffuser is identical to that in the example of embodiment in variant 4, but the sliding tube enabling it to be supplied with water is housed in the support shaft of core (K2).

Variant 6

A variant 6, concerning a supersonic outflow, is derived from variants 3 and 4 described above, and also enables the rate of compression and/or the efficiency of the device to be modified at any time, exactly as with variant 5; it also enables any pressure waves or shock waves which may in certain cases develop in zones (D1), (NT) or (C3) of variants 3 or 4 to be eliminated or displaced to the outlet of the device; the principle of this variant is identical to that of variant 5, but the variable geometry concerns the device's second neck; in this variant, zones (C3), (C4) and (D) of variants 3 and 4 are replaced by a system with variable geometry controlled from outside the device and enabling the neck section between (C3) and (D) to be modified; the system of variable geometry is obtained by any mechanism enabling the section of this neck to be modified, such as those described in the examples below.

In the example of FIG. 6, the system of variable geometry is obtained by replacing (C3), (C4) and (D) by a nozzle (CG1) with deformable walls which may be adjusted in order to be, preferably, slightly divergent when the device is brought into service and then convergent subsequently; this nozzle serves as a pressure reduction/cooling convergent nozzle (C3) and as an adiabatic compression convergent nozzle (C4); (GC1) is followed by a divergent nozzle (DG1) also with deformable walls, and nozzle (DG1) then serves as a divergent adiabatic compression nozzle (D). The system of deformable walls may be of the same type as that described in section 2.1 and represented in FIG. 2.1, for example.

Since the speed of the gas for compression must preferably be sonic in the second neck of the device, this possibility of modifying its section enables the temperature and flow rate of the gas for compression to be made mutually independent at the outlet of the adiabatic pressure reduction mixer head, whilst complying with the sonic outflow constraint in this neck; this enables either the flow rate of the gas for compression, or its temperature, to be modified at the inlet of the second neck—by modifying the temperature in (C) or by modifying the flow rate of the sprayed liquid, causing a modification of the rate of compression of the device and its efficiency—or both simultaneously.

Finally, when the device is brought into service, the first nozzle with variable geometry is kept in a slightly divergent position, until the rate of compression of the device is sufficient high for the pressure wave which may develop in (D1) to be displaced into the second divergent nozzle (DG); after this evacuation of the pressure wave, both variable geometry nozzles may gradually move to their service positions, while the pressure wave moves away to the outlet of the device as the two nozzles with variable geometry come closer to their service positions.

The other elements of the device are identical with those described in variants 3 or 4.

In the preferential example of FIG. 6.1, convergent compression/cooling nozzle (C3) and convergent adiabatic supersonic compression nozzle (C4) of variants 3 or 4 are replaced by a duct (N3), which is preferably slightly divergent, with an inlet diameter slightly higher than that of (D1) in preference, inside of which a profiled core (K3), mounted on a shaft traversing for example one or both ends of the device and enabling the position of (K3) to be adjusted, can slide axially; the position of core (K3) can be adjusted manually or automatically from outside the device by a thread mounted on a bearing, by a jack, or by any other external system permitting it.

The spray diffuser is housed in zone (NT) or (N3).

In its most simplified concept, divergent duct (D) and possibly calming chamber (T) can simply consist of a prolongation of slightly divergent duct (N3).

The other elements of the device are identical with those described in variants 3 or 4.

Core (K3) is a part the aerodynamic profile of which enables the losses of charge of the gas for compression to be minimized; it consists of an upstream part (K'3) of section increasing in the gas outflow direction, a downstream part (K'''3) of constant section or section decreasing in the gas outflow direction, and an intermediate part (K''3) the continuous generator of which, without corners, links the generator of (K'3) and that of (K'''3).

Part (K'3) of core (K3) is housed in duct (N3).

Depending on the application sought for the device, and depending on the temperatures of the gas for compression on exit from the supersonic pressure reduction mixing tube (D1), core (K3) may be made from carbon steel for temperatures under 300°, stainless steel, steel cooled by internal circulation of cooling fluid, ceramic material, or any other material with satisfactory properties when subject to the abrasion and temperatures applied.

The example of embodiment represented in FIG. 6.1 shows a shaft traversing core (K3) from side to side and resting on bearings placed in the inlet chamber and in the calming chamber, with the latter including a position adjustment thread; the spray diffuser is placed at the end of a tube sliding on the shaft.

When the gas for compression flows into duct (N3), the free space between (K'3) and duct (N3) constitutes a convergent nozzle which plays the same role as convergent compression/cooling nozzle (C3) and convergent supersonic adiabatic compression nozzle (C4) in variants 3 or 4, and the free space between (K'''3), and (D) constitutes a divergent nozzle which plays the same role as convergent adiabatic compression nozzle (D) described in variants 3 or 4; the neck, i.e. the minimum passage section between these two nozzles, is generally 5 located between the outlet of duct (N3) and the maximum diameter of (K''3), and its section Ss may be modified at any time from outside by adjusting the axial position of core (K3); this adjustment of the section in the neck allows:

When brought into service: core (K3) to be withdrawn completely from duct (N3) so that the initial pressure wave, which may develop in a supersonic regime in a divergent nozzle when the overpressure supplied by the primary start compressor is sufficiently high, is located downstream from the exit of duct (N3); this overpressure and the maximum diameter of (K3) are chosen so that, when core (K3) is gradually introduced into duct (N3), the zone where the pressure wave is located always remains divergent, and the pressure wave remains there until (K3) finds its definitive place in (N3).

During normal operation: the temperature, pressure and flow rate of the gas for compression to be made mutually independent on exit from the second neck, giving the device the same advantages as those in the example of FIG. 6: possibility of adjusting the flow rate, compression rate or efficiency.

As an example of embodiment, a device according to FIG. 6.1 has the same performance specifications as the example of embodiment concerning variant 4, with the following modifications enabling the flow and compression rates of the gas for compression to be adjusted:

Replacement of convergent nozzles (C3) and (C4) by a duct (N3), with an inlet diameter close to 0.388 m, an outlet diameter close to 0.390 m, and a length of 1.0 m; duct (N3) is made from twin-envelope carbon steel, Replacement of mixing tube (D) of inlet diameter 0.209 m by a mixing tube (D) of the same design but of inlet diameter 0.390 m, Addition of a core (K3) made of stainless steel cooled by internal circulation of water of maximum diameter 0.388 m, of minimum diameter 0.04 m at the inlet of (K'3) and at the outlet of (K'''3), of total length 1.2 m, supported by a shaft of diameter 40 mm resting on a bearing installed at (T), with a position adjustment thread, and on a second bearing installed at the end of (C), The spray diffuser is identical to that in the example of embodiment in variant 4, but the sliding tube enabling it to be supplied with water is housed in the support shaft of core (K3).

Variant 7

A variant 7, concerning a supersonic outflow, results from the simultaneous application of variants 5 and 6 to a given device, and enables the sections of both necks of the device to be adjusted independently of one another at any time from outside, and thus the flow rate of the gas for compression, the compression rate of the device, and its energy efficiency to be modified, while allowing, in this instance too, any pressure waves or shock waves which may in certain cases develop in the supersonic mixing tubes of variants 3, 4 or 5 to be eliminated or displaced to its outlet; in this variant, zones (C3), (C4) and (D) of variant 5 are replaced as in variant 6 by a nozzle of variable geometry which may be adjusted to make it slightly divergent when the device is brought into service, and subsequently convergent, followed by a divergent nozzle of variable geometry; the diameter of the neck between the two nozzles may be permanently adapted to the diameter of the first neck of the device, i.e. to the flow rate and physical conditions of the gas for compression at the inlet, and to the physical conditions at the outlet of the device, i.e. to the flow rate of the sprayed liquid, and thus to the device's compression rate and efficiency.

The other elements of the device are identical with those described in variants 5.

This variant thus has the combined benefits of variants 5 and 6.

In the example in FIG. 7, the systems of variable geometry are obtained by using nozzles with deformable walls of the same type as the one described in section 2.1 and represented in FIG. 2.1 for example.

In the preferential example of FIG. 7.1, convergent compression/cooling nozzle (C3) and convergent adiabatic supersonic compression nozzle (C4) of FIG. 5.1 are replaced by a duct (N3), which is preferably slightly divergent, with an inlet diameter slightly higher than that of (D1) in preference, inside of which a core (K3), the axis of which is mounted on a shaft traversing for example one or both ends of the device can slide axially; the position of core (K3) can be adjusted manually or automatically from outside the device by a thread mounted on a bearing, by an external jack, or by any other external system permitting it.

In a more simplified concept, zones (N2), (NT), (N3), (D) and (T) can be grouped together into a single duct of slightly divergent section.

Core (K3) is a fully revolving part the aerodynamic profile of which enables the losses of charge of the gas for compression to be minimized; it consists of an upstream part (K'3) of section increasing in the gas outflow direction, a downstream part (K'''3) of constant section or section decreasing in the gas outflow direction, and an intermediate part (K''3) the continuous generator of which, without corners, links the generator of (K'3) and that of (K'''3).

Part (K'3) of core (K3) is housed in duct (N3).

The spray diffuser is housed in one of zones (N2), (NT) or (N3), between (K''2), the downstream end of (K2), and (K'3), the upstream end of (K3).

The other elements of the device are identical with those in variant 5.

Depending on the application sought for the device, and depending on the temperatures of the gas for compression on exit from the supersonic pressure reduction mixing tube (D1), core (K3) may be made from carbon steel for temperatures under 300°, stainless steel, steel cooled by internal circulation of cooling fluid, ceramic material, or any other material with satisfactory properties when subject to the abrasion and temperatures applied.

The example of embodiment represented in FIG. 7.1 shows a shaft traversing from side to side core (K2) and core (K3), and resting on bearings positioned in the combustion chamber and in the calming chamber; each bearing includes a motor enabling the axial position of each of the cores to be adjusted, and the spray diffuser is installed directly on the downstream end of (K'''2).

As in the example of FIG. 5.1, the free space between (K2), (C1), (NT') and (N2) has a first neck of section S's which is adjustable from the outside by adjusting the axial position of core (K2).

Similarly, as in the example of FIG. 6.1, the free space between (K3), (N3) and (D) has a second neck of section Ss which is adjustable from the outside by adjusting the axial position of core (K3).

These possibilities for adjusting the section of each neck give the example in FIG. 7.1 the combined benefits of the examples in FIGS. 5.1 and 6.1 described above.

As an example of embodiment, a device according to FIG. 7.1 enabling nearly 20,000 Nm3 of air to be compressed from 1 bar A to 2.5 bar A, and enabling the flow rate and compression rate of the gas for compression to be adjusted, may be obtained by making the following modifications to the example of embodiment of variant 5:

Replacement of (NT') and (N2) by a divergent nozzle of the same inlet diameter but of length 1.5 m and of outlet diameter close to 1.034 m, enabling the air pressure to be reduced to 0.004 bar A.

Replacement of convergent nozzles (C3) and (C4) by a duct (N3), with an inlet diameter close to 1.034 m, an outlet diameter close to 1.036 m, and a length of 2.07 m; duct (N3) is made from twin-envelope carbon steel, Replacement of mixing tube (D) of inlet diameter 0.209 m by a mixing tube (D) of the same design but of inlet diameter of 1.036 m, of outlet diameter 1.176 m, and of length 2.0 m, Replacement of chamber (T) by a chamber of the same design, but of diameter 1.176 m and of length 1.41 m, Addition of a core (K3) made of stainless steel cooled by internal circulation of water of maximum diameter 1.034 m, of minimum diameter 0.06 m at the inlet of (K'3) and at the outlet of (K'''3), of total length 3.1 m, supported by a shaft of diameter 60 mm resting on a bearing installed at (T), with a position adjustment thread, and on a second bearing installed at (C), and on a third intermediate bearing, The spray diffuser is of a design identical to that in the example of embodiment of variant 4, but the sprayed water flow rate is reduced to 1.0 kg per second and the diffuser is supplied by a sliding tube housed in the support shaft of core (K3).

Variant 8

A variant 8, concerning the spray diffusers of basic option 1 or of variants 2 to 7 described above, is represented in FIG. 8; it consists in using as a fluid to assist spraying a part of the compressed gas generated by the device, or steam generated by heat recovery from the compressed gas after the calming chamber. This variant enables the size of the droplets of sprayed liquid to be reduced and the initial speed to be increased without any addition of external mechanical energy, and thus to improve the device's energy efficiency.

The example in FIG. 8 concerns the same type of installation as that of FIG. 7.1, but it is fitted with a device for assisting spraying from compressed air taken from the outlet of the device.

As an example of embodiment, a device according to FIG. 8 enabling nearly 20,000 Nm3 of air to be compressed from 1 bar A to 2.5 bar A, and enabling the flow rate and compression rate of the gas for compression to be adjusted, may be obtained by making the following modifications to the example of embodiment of variant 7:

The outlet diameter of (C1) becomes 0.322 m

Replacement of (NT) and (N2) by a divergent nozzle of same design but of inlet diameter 0.322 m, of outlet diameter 1.042 m, and of length 1.439 m, enabling the air pressure to be reduced to 0.004 bar A Replacement of duct (N3) by a new duct of the same design but of inlet diameter close to 1.042 m, outlet diameter close to 1.044 m, and length 2.086 m, Spraying is assisted by the use of 0.26 kg/second of "compressed air-steam" mixture taken from the outlet of the device, The sprayed water flow rate is reduced to 0.61 kg/second Replacement of core (K3) by a new core of maximum diameter 1043 mm, of minimum diameters 137 mm at the ends of (K'3) and (K'''3), and of length 3.1 m, supported by a shaf of diameter 140 mm inside which the spray water and the spray assistance air circulate.

Variant 9

A variant 9, concerning the spray diffusers of basic option 1, or of variants 2 to 8 described above, is represented in FIG. 8; it consists in heating the liquid used in the spray diffusers before it is introduced into the diffusers, through the use of the heat recovered from the compressed gas after the calming chamber (T), where recovery may possibly go as far as the extent of condensing the sprayed liquid vapour; when the pressure of the liquid for spraying is reduced, this superheating enables the size of the droplets to be reduced and their initial speed to be increased whilst minimizing the external mechanical energy contribution, and thus enables the device's energy efficiency to be improved.

If necessary, failing this, or in addition to this heat recovered downstream from the calming chamber, any other source of heat internal to the device, such as heat recovered in twin envelopes, or heat external to the device, may be used.

Figure 9:
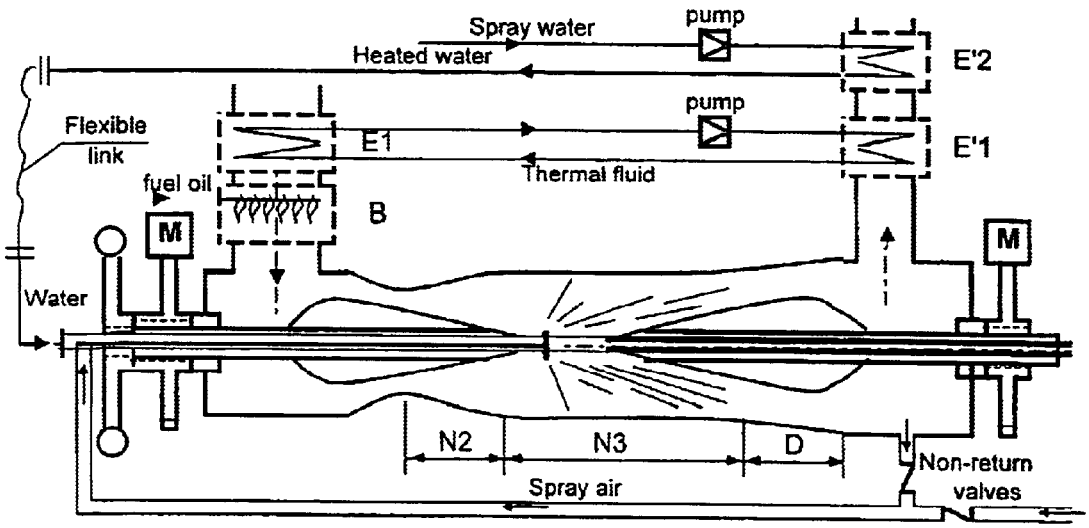
FIG. 9 is a schematic representation of a ninth embodiment of the present invention.

The example in FIG. 9 concerns the same type of installation as that of FIG. 8, in which the liquid for spraying is first heated in a thermal exchanger installed in the compressed gas's evacuation line.

As an example of embodiment, a device according to FIG. 9 with the same dimensions and the same performance specifications as the example of embodiment of variant 8, with in addition a compressed air outlet temperature increased by 20° C., may be obtained by adding to the evacuation line a thermal exchanger (E'1) enabling the spray water to be heated to 40° C.

Variant 10

A variant 10 concerns the installation in parallel or in series of several devices described in basic option 1 and variants 2 to 9 to facilitate its construction, reach compression rates which cannot be obtained by a single device, improve the overall efficiency of the installation, or again to facilitate use of the installation; the devices may be mutually separate as in the example of FIG. 10 described below, or interlocking, as in the example of FIG. 10.1, which concerns two devices installed in parallel in a single envelope, or, as in the examples of FIGS. 10.2, 10.3 and 10.4, in which two devices in claims 2 and 9 are installed in series and interlocking, with a suction line, inlet chamber (C), mixer heads (C1) and (C2), and common inlet core serving as a core (K) for the first subsonic device and core (K2) for the second supersonic device.

The example in FIG. 10 enables the entry into service of a supersonic air compression device with a high compression rate, with the help of an inefficient start-up compressor. It consists of two separate devices installed in series: a first sonic device according to FIG. 2.3 with a preceding core allowing the air flow rate to be adjusted, and the suction line of which includes a filter, silencing device, compressor and fuel oil burner, followed by a supersonic downstream device according to FIG. 9 with cores upstream and downstream, the suction line of which includes an air heating exchanger using a thermal fluid; the evacuation line of the downstream device includes a recovery exchanger allowing the thermal fluid to be heated, followed by a second recovery exchanger allowing the spray water to be heated.

The first upstream device is used only when the installation is brought into service, to allow overpressure sufficient to allow the second device to start, after which the first is stopped.

The second downstream device according to FIG. 9, used in normal operation, and which must thus be high-performance, includes additionally a heat recoverer allowing the inlet air to be heated, a second recoverer allowing the spray water to be heated, and a spray assistance device through the use of compressed air taken from the installation's outlet.

The example in FIG. 10.1 allows a very high capacity compressor to be made through the use in parallel of two devices identical to that represented in FIG. 8; the two devices installed in parallel are interlocking, the cores of each being installed in a common envelope; this arrangement enables the dimensions of the cores, which would become too large in a very large capacity single device, to be reduced.

The example in FIG. 10.2 is a simplified version of the example in FIG. 10, in which the two devices are interlocking; it consists of a supersonic device according to FIG. 9 in which ducts (N2), (NT), (N3) and (D) are grouped into a single slightly divergent duct, in which zone (C1) can play the role of zones (C1) and (C2) of the sonic device represented in FIG. 2.3; core (K2) of the supersonic device includes spray diffusers distributed all along its axis, and can play the role of core (K1) in the sonic device represented in FIG. 2.3.

When the installation is brought into service, core (K3) is completely withdraw into the calming chamber (T); the compressor, burner and spray diffusers of core (K1) are brought into service, and only the upstream part of the device is used, like a sonic installation; when the downstream pressure of (C2) is sufficiently high, the compressor is stopped, the downstream supersonic part of the device is also brought into service and, when the pressure in the calming chamber is sufficiently high, the spray diffusers of core (K1), i.e. those of the sonic device, are gradually stopped; the whole installation then operates like a supersonic device only, and the flow rate, compression rate and efficiency of the installation can be adjusted by regulating the burner, the flow rate of the sprayed liquid, and the positions of (K2) and (K3).

The example in FIG. 10.3 is also a simplified version of a sonic device interlocking in a supersonic device to facilitate its entry into service; it consists of a supersonic device according to FIG. 7 with nozzles of variable geometry by deformable walls in which the mixer head (CG) of the supersonic device can play the role of mixer heads (C1) and (C2) of the sonic device represented in FIG. 2.3; mixer head (CG) of the supersonic device also includes spray diffusers (R) distributed all along its axis, which play the same role as the spray diffusers distributed in zone (C2) of the sonic device.

When the installation is brought into service, duct (CG1) is placed in start position, slightly divergent; the compressor, burner and spray diffusers of the sonic device are brought into service, and only the upstream part of the device is used, like a sonic installation; when the pressure downstream from (C2) is sufficiently high, the compressor is stopped, the downstream supersonic part of the device is also brought into service and, when the pressure in the calming chamber is sufficiently high, the spray diffusers of the sonic device are also gradually stopped; the whole installation then operates like a supersonic device only, and the flow rate, compression rate, and efficiency of the installation can be adjusted by regulating the burner, the flow rate of the sprayed liquid, and the sections of each of both necks of the device.

The example of FIG. 10.4 allows, in a very simplified manner, the same result as the examples of FIGS. 10 and 10.2 to be obtained, i.e. it allows the a device for compressing supersonic air at high compression rate to be brought into service, by means of an inefficient start-up compressor, it consists of a supersonic device according to FIG. 8 and a sonic device according to FIG. 2.4 which installed in series and interlocking.

In this installation, ducts (NT'), (N2), (NT) and (N3) are grouped in a single, slightly divergent duct, and core (K3) and spray diffuser (R) of the supersonic device are also used as core (K1) and as diffuser (R) of the sonic device when the latter is used.

When the installation is brought into service, only the sonic device is used, and core (K2) is then fully withdrawn into (C), until a pressure gain is obtained sufficient to allow the supersonic device to be brought into service, i.e. to allow (K2) to be introduced into (C1) in order to create a mixing tube.

As an example of embodiment, a device according to FIG. 10.2 enabling nearly 20,000 Nm3 of air to be compressed from 1 bar A to 2.5 bar A, and enabling the flow rate and compression rate of the gas for compression to be adjusted, may be obtained with a start-up compressor developing a overpressure of only 100 mbar, by making the following modifications to the example of embodiment of variant 8:

Mixer head (C1) is replaced by a mixer head of the same design, playing the role of (C1) with respect to the supersonic operation and of (C1)+(C2) with respect to the sonic operation, of the same inlet and outlet diameters, but of length 1.5 m, Inlet core (K2) is replaced by a new core playing the role of (K2) with respect to supersonic operation and of (K) with respect to sonic operation, of the same diameters but of total length 1.3 m; its downstream part (K'''), which slides in (C1), includes in its periphery the spray diffusers required for sonic operation.

INDUSTRIAL APPLICATIONS OF THE INVENTION

The device according to the invention has applications in industrial processes using compressed gases, compressed air or water vapour, and is of particular interest in thermal power stations: see examples 5, 6, 7, 8 and 9 below; it allows, for example, the following installations to be made with competitive equipment costs, maintenance costs and energy efficiency levels:

1—Installations for the production of air or compressed gases for use in satisfying industrial requirements and allowing very high flow rates to be obtained, from 1000 Nm3/h to several million Nm3/h, at pressures between 1.5 bar A and 20 bar A, or higher.

2—Vacuum systems using high flow rates of air or gas to meet the requirements of industrial processes, requirements of thermodynamic test benches such as Aeronautical, Climatic, etc., benches.

3—Use of the residual heat of smoke in power boilers to achieve partial vacuum in their combustion chambers, thus preventing the permanent use of drawing ventilators, enabling several hundred or thousand kW of electrical energy to be economised.

4—mechanical recompression of low-pressure vapour such as steam for example, where the liquid injected is water, to obtain steam at higher pressure; in this example the suction line includes if necessary a thermal exchanger allowing the low-pressure steam to be superheated.

5—Steam-driven thermal power stations in which the high-pressure steam boilers would be replaced by the same device as that described in the previous example; in such power stations, the recompressed steam is superheated, and then has its pressure reduced through turbines before being returned to the inlet of the device, and steam condensers are then necessary only to condense at low temperature a steam flow rate equal to the flow rate of water injected in the device. In such power stations, the hot source of the thermodynamic cycle, which is close to 500 to 700° C., is substantially higher than that of traditional power stations: 250° C. to 310° C., corresponding to the boiling point of steam at 40 to 100 bar; it thus allows substantially higher energy efficiency levels, which may exceed 45%.

6—Gas turbine thermal power stations, in which a device according to FIG. 9, for example, but without a burner, installed in the smoke circuit downstream from the turbine, uses the latent heat of the smoke to recompress part of the smoke before reinjecting it downstream of the compressor or gas turbine, consequently enabling the flow rate and thus the power consumed by this compressor to be reduced; a cycle of this kind allows, for example, the efficiency of a gas turbine to be increased from 27% to nearly 45%, if of course the appropriate adaptations are made.

7—Gas turbine thermal power stations, in which a device according to FIG. 9 for example, but without a burner, installed in the smoke circuit downstream from the turbine, uses the latent heat of the smoke to create a vacuum allowing the power of the gas turbine to be improved; a cycle of this kind also enables the efficiency of a gas turbine to be increased from 27% to nearly 45%, if of course the appropriate adaptations of the turbine are made.

8—Thermal power stations using the device's compression cycle, consisting for example of the device according to FIG. 10.1 with additionally an air turbine (TB) installed downstream from the burner of the suction line and the air-steam turbines installed in the evacuation line; a cycle of this kind enables efficiency levels higher than 56% to be attained, taking account of the various losses of the system: thermal losses, losses of charge of the device, losses by friction, isentropic efficiency of the turbine, etc.

9—Thermal power stations using the device's compression cycle, and consisting for example of the device according to FIG. 10.1 without burner (B) on the suction line, but with a burner and an air-steam turbine installed on the evacuation line upstream from exchanger (E'1); a cycle of this kind enables efficiency levels higher than 60% to be attained, taking account of the various losses of the system: thermal losses, losses of charge of the device, losses by friction, isentropic efficiency of the turbine, etc.

What is claimed is:

1. A gas compressor comprising:

bringing means for bringing a low pressure entering gas at a high temperature;

a convergent pressure reduction head (C1) for increasing a gas speed of said gas toward a sonic speed, said head being placed after said bringing means;

a convergent nozzle (C2) placed after said convergent head (C1), said convergent nozzle (C2) performing a pressure reduction and cooling of said gas, wherein said gas is cooled and at the same time maintained at a high velocity;

a cooling system (R) comprising a set of liquid spray diffusers for spraying a liquid in said convergent nozzle (C2), said liquid spray diffusers having adjustable flow rates and adjustable positions and being distributed along a length of said convergent nozzle (C2), enabling said gas speed to be maintained at a speed lower than a sonic speed along said length of said convergent nozzle (C2);

a divergent tube (D) placed after said convergent nozzle (C2) for compressing the gas by reducing its speed to a normal subsonic outflow speed; and an evacuation line in which said gas is at a lower temperature and at a higher pressure.

2. The gas compressor according to claim 1, comprising a transition zone (N) placed between said convergent pressure reduction head (C1) and said convergent nozzle (C2).

3. The gas compressor according to the claim 2, wherein said convergent nozzle (C2) and said divergent tube (D) have variable geometry with an adjustable outlet section of said convergent nozzle (C2), with an adjustable inlet section of said divergent tube (D), and with an adjustable section of a neck between said convergent nozzle (C2) and said divergent tube (D) according to a flow and temperature of said gas to be compressed.

4. The gas compressor according to claim 1, wherein, in order to obtain very small droplets and thus to facilitate their evaporation, a used liquid in said liquid spray diffusers is heated before being introduced into said liquid spray diffusers.

5. The gas compressor according to claim 1, comprising, in series or in parallel, several convergent pressure reduction heads (C1), several convergent nozzles (C2), several cooling systems (R), and several divergent tubes (D) installed in a same envelope.

6. The gas compressor according to claim 1, comprising a calming chamber (T) placed between said divergent tube (D) and said evacuation line.

7. The gas compressor according to claim 1, wherein said means for bringing a low pressure entering gas at a high temperature, comprise means for heating said gas such as a burner (B), or heat exchangers (E1, E2, En) using recycled heat, or any other source of heat available, and an inlet chamber (C) placed between said means for heating and said convergent head (C1).

8. The gas compressor according to claim 1, wherein said evacuation line comprises hot gas recycling equipment, recovery exchangers (E'1, E'2, E'n) equipment, and silencing equipment (S') recovering an excess heat contained in exhausted gas and reducing a noise level, said equipments being eventually fed by only a part of the compressed gas.

9. A gas compressor comprising:

bringing means for bringing a low pressure entering gas at a high temperature;

a convergent pressure reduction head (C1) for increasing a speed of said gas up to a sonic speed, said head being placed after said bringing means;

a divergent supersonic pressure nozzle (D1) placed after said convergent pressure reduction head (C1) and aimed at increasing said gas speed to reach a supersonic flow;

a transition zone (NT) placed after said divergent supersonic nozzle (D1);

a convergent compression and cooling nozzle (C3) placed after said transition zone (NT) reducing said gas speed with continuation of cooling;

a cooling system (R) comprising a set of liquid spray diffusers for spraying a liquid in said transition zone (NT) and in said convergent compression and cooling nozzle (C3);

a convergent compression nozzle (C4) placed after said convergent compression and cooling nozzle (C3), in which said gas speed continues to decrease;

a divergent tube (D) placed after said convergent compression nozzle (C4) for compressing said gas by reducing its speed to a normal subsonic outflow speed; and an evacuation line in which said gas is at a lower temperature and at a higher pressure.

10. The gas compressor as claimed in claim 9, wherein the set of liquid spray diffusers comprises a set of diffusers distributed radialy on sections perpendicular to the gas flow, placed in an inlet of said convergent compression and cooling nozzle (C3) or in said transition zone (NT).

11. The gas compressor as claimed in claim 10, wherein said convergent head (C1) and said divergent supersonic nozzle (D1) comprises a convergent nozzle followed by a divergent nozzle, both with a variable geometry, for enabling a section of a neck therebetween to be adjusted according to a flow and temperature of the gas to be compressed.

12. The gas compressor as claimed in claim 10, wherein any of said convergent compression and cooling nozzles (C3), of said convergent compression nozzle (C4), and of said divergent tube (D) have a variable geometry, which enables a section of a neck therebetween to be adjusted according to the flow, temperature, and pressure of the gas to be compressed.

13. The gas compressor as claimed in claim 11, wherein said convergent compression and cooling nozzle (C3), said convergent compression nozzle (C4), and said divergent tube (D) have a variable geometry, which enables a section of a neck therebetween to be adjusted according to a flow, temperature, and pressure of the gas to be compressed.

* * * * *